US008925648B2

(12) United States Patent
Lucon

(10) Patent No.: US 8,925,648 B2
(45) Date of Patent: Jan. 6, 2015

(54) AUTOMATIC CONTROL OF OSCILLATORY PENETRATION APPARATUS

(76) Inventor: Peter A. Lucon, Butte, MT (US)

( * ) Notice: Subject to any disclaimer, the term of this patent is extended or adjusted under 35 U.S.C. 154(b) by 727 days.

(21) Appl. No.: 12/736,742

(22) PCT Filed: May 26, 2009

(86) PCT No.: PCT/US2009/003256

§ 371 (c)(1),
(2), (4) Date: Nov. 5, 2010

(87) PCT Pub. No.: WO2009/145897

PCT Pub. Date: Dec. 3, 2009

(65) Prior Publication Data

US 2011/0056750 A1 Mar. 10, 2011

Related U.S. Application Data

(60) Provisional application No. 61/130,293, filed on May 29, 2008.

(51) Int. Cl.
*E21B 7/24* (2006.01)
*E21B 44/00* (2006.01)

(52) U.S. Cl.
CPC .. *E21B 7/24* (2013.01); *E21B 44/00* (2013.01)
USPC ..... 175/56

(58) Field of Classification Search
USPC ..... 327/156–158; 331/34; 375/376; 175/55, 175/56, 19, 22, 57, 105, 24, 389, 322, 106; 173/49, 185, 142; 166/177.6; 73/152.47
See application file for complete search history.

(56) References Cited

U.S. PATENT DOCUMENTS

| | | | | |
|---|---|---|---|---|
| 2,745,998 | A * | 5/1956 | McPherson, Jr. | 318/118 |
| 2,858,108 | A * | 10/1958 | Wise et al. | 175/56 |
| 2,975,846 | A | 3/1961 | Bodine, Jr. | |
| 3,004,389 | A | 10/1961 | Muller | |
| 3,375,884 | A | 4/1968 | Bodine, Jr. | |
| 3,379,263 | A | 4/1968 | Bodine, Jr. | |
| 3,461,979 | A | 8/1969 | Newfarmer | |
| 3,477,237 | A | 11/1969 | Orkney | |
| 3,572,139 | A | 3/1971 | Shatto, Jr. et al. | |
| 3,633,688 | A | 1/1972 | Bodine | |
| 3,736,843 | A | 6/1973 | Leibundgut | |

(Continued)

FOREIGN PATENT DOCUMENTS

WO WO01/83933 8/2001

*Primary Examiner* — David Andrews
*Assistant Examiner* — Ronald Runyan
(74) *Attorney, Agent, or Firm* — Robert M Hunter

(57) ABSTRACT

A system and method for controlling an oscillatory penetration apparatus. An embodiment is a system and method for controlling a sonic drill having a displacement and an operating range and operating at a phase difference, said sonic drill comprising a push-pull piston and eccentrics, said method comprising: operating the push-pull piston at an initial push-pull force while the eccentrics are operated at a plurality of different operating frequencies within the operating range of the sonic drill and measuring the displacement at each operating frequency; determining an efficient operating frequency for the material being drilled and operating the eccentrics at said efficient operating frequency; determining the phase difference at which the sonic drill is operating; and if the phase difference is not substantially equal to minus ninety degrees, operating the push-pull piston at another push-pull force.

46 Claims, 20 Drawing Sheets

(56) References Cited

U.S. PATENT DOCUMENTS

| | | | | | |
|---|---|---|---|---|---|
| 3,741,315 | A | | 6/1973 | Hilton | |
| 3,774,731 | A | * | 11/1973 | Zerb | 188/268 |
| 4,150,568 | A | | 4/1979 | Berger et al. | |
| 4,330,156 | A | | 5/1982 | Gurries | |
| 4,384,625 | A | | 5/1983 | Roper et al. | |
| 4,527,637 | A | | 7/1985 | Bodine | |
| 4,693,325 | A | | 9/1987 | Bodine | |
| 4,836,299 | A | | 6/1989 | Bodine | |
| 5,004,005 | A | | 4/1991 | Porritt et al. | |
| 5,141,061 | A | | 8/1992 | Henneuse | |
| 5,417,290 | A | | 5/1995 | Barrow | |
| 5,540,295 | A | | 7/1996 | Serrette | |
| 5,549,170 | A | | 8/1996 | Barrow | |
| 5,562,169 | A | | 10/1996 | Barrow | |
| 2,911,192 | A | | 11/1999 | Boucher | |
| 6,129,159 | A | | 10/2000 | Scott et al. | |
| 6,736,209 | B2 | | 5/2004 | Ivannikov et al. | |
| 6,863,136 | B2 | | 3/2005 | Bar-Cohen et al. | |
| 7,191,852 | B2 | | 3/2007 | Clayton | |
| 7,234,537 | B2 | | 6/2007 | Johnson | |
| 7,341,116 | B2 | | 3/2008 | Fincher et al. | |
| 2006/0157280 | A1 | | 7/2006 | Fincher et al. | |
| 2007/0289778 | A1 | | 12/2007 | Watkins et al. | |

* cited by examiner

AUTOMATIC CONTROL OF OSCILLATORY PENETRATION APPARATUS

CROSS-REFERENCE TO RELATED APPLICATIONS

This application claims the benefit of U.S. Provisional Patent Application No. 61/130,293, filed May 29, 2008, the disclosure of which patent application is incorporated by reference as if fully set forth herein.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. DE-FG02-06ER84618 awarded by the U.S. Department of Energy.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates to automatic control of an oscillatory penetration apparatus. In particular, the invention relates to systems and methods for control of sonic drilling.

Sonic drilling (rotary, vibratory drilling) is an advanced drilling technique that offers great advantages for obtaining the relatively undisturbed core samples that are needed to gather subterranean environmental data. In addition, sonic drilling uses a unique method for the minimization, or even elimination, of the use of drilling fluids and the production of cuttings that are brought to the surface as ground penetration occurs. However, the sonic drilling process is highly complex and, as such, requires unique and advanced operator skills. Moreover, the depths to which background art sonic drilling techniques can be used are limited, with practical drilling depths not exceeding about 1,000 to 1,500 feet.

Efficient application of sonic drilling is realized by sustaining the drill string at resonance throughout the entire drilling process. This task is complicated by the fact that there is a strong coupled relationship between the frequency of the sonic driver, or drill head, and the forces applied (magnitude and direction) to the drill string by: (1) the sonic drill bit; (2) the weight of the drill string, which changes as more depth is achieved; and (3) the resistance to penetration imposed by both the side-load (lateral) forces of the drilled material (e.g., soil) and the resistance to penetration at the drill bit. All of these factors are coupled (interrelated) and must be kept in the proper relationship to keep the drill string in resonance to ensure peak performance. This complex relationship affects the power utilization efficiency, as well as the ability of the drill string to penetrate the earth. In addition, the collective factors affecting drill string penetration are also a function of both drilling process conditions and subterranean geophysical conditions.

Because of these complex and coupled issues, current sonic drilling technology requires highly trained operators to directly control driving frequency, power input and the constant push or pull force applied to the drill string. However, because of the complexity of coupled factors, and lack of information (measurements of drill string performance), even the most skilled technicians cannot obtain optimal performance from background art sonic drilling equipment. In fact, measures that must be taken to fully achieve maximum performance and efficiency in sonic drilling are counterintuitive, and, hence, are not even implemented by skilled operators. As such, there is a compelling need for an automated control system that maintains the drill string at an optimal sonic drilling condition.

The need for an automated sonic drilling control has been identified, and efforts to provide automated control have been attempted, but have been unsuccessful. However, it is significant to note that these previous efforts have not been attempted using a fundamental understanding of the parameters involved, both physically or analytically. Hence, the goal of developing a much-needed, automated drilling methodology for sonic drilling was heretofore unachievable. What has been needed is a technology that is based on a fundamental understanding of the physics of the resonant system, from which dynamic analytical models to use in quantifying all aspects the resonant system may be assembled.

The background art is characterized by U.S. Pat. Nos. 2,911,192; 2,975,846; 3,004,389; 3,375,884; 3,379,263; 3,461,979; 3,477,237; 3,572,139; 3,633,688; 3,736,843; 3,741,315; 4,330,156; 4,384,625; 4,693,325; 4,836,299; 4,527,637; 5,141,061; 5,417,290; 5,540,295; 5,549,170; 5,562,169; 6,129,159; 6,736,209; 6,863,136; 7,191,852; 7,234,537; and 7,341,116; and U.S. Patent Application No. 2007/289,778; the disclosures of which patents and patent application are incorporated by reference as if fully set forth herein. The background art is also characterized by WO01/83933.

BRIEF SUMMARY OF THE INVENTION

The purpose of the invention is to provide automatic control of oscillatory penetration systems. One advantage of some embodiments of the invention is that faster penetration of the material being drilled can be achieved. Another advantage is that damage to sonic drilling equipment can be prevented. Another advantage is that greater depths can be achieved with sonic drilling.

In an illustrative embodiment, the invention is a method for controlling an oscillatory penetration apparatus, said sonic penetration apparatus being subjected to an oscillatory input force waveform at an input force location and vibrating in accordance with an oscillatory response waveform, said method comprising: driving the oscillatory penetration apparatus; measuring a response of the oscillatory penetration apparatus; and controlling the oscillatory penetration apparatus; wherein said measuring a response step comprises measuring at least a phase angle between the oscillatory input force waveform and the oscillatory response waveform. In one exemplary embodiment, controlling the oscillatory penetration apparatus comprises adjusting a push-pull force being imposed on the oscillatory penetration apparatus to produce a desired (e.g., a maximum achievable) penetration rate. In another exemplary embodiment, the oscillatory response waveform is characterized by measuring an acceleration, a velocity, a displacement or a jerk at a measurement location on said oscillatory penetration apparatus that characterizes said response at said input force location. In another exemplary embodiment, the efficiency of the oscillatory penetration apparatus is maximized by operating the oscillatory penetration apparatus at a phase angle between the oscillatory input force waveform and the oscillatory acceleration waveform of about +90 degrees. In another exemplary embodiment, the efficiency of the oscillatory penetration apparatus is maximized by operating the oscillatory penetration apparatus at a phase angle between the oscillatory input force waveform and the oscillator velocity waveform of about zero degrees. In another exemplary embodiment, the efficiency of the oscillatory penetration apparatus is maximized by operating the oscillatory penetration apparatus at a phase angle between the oscillatory input force waveform and the oscillator displacement waveform of about −90 degrees. In another exemplary embodiment, the efficiency of the oscillatory penetration apparatus is maximized by operating the apparatus at a phase angle between the oscillatory input force waveform and the oscillator jerk waveform of about +180 degrees or −180 degrees.

In another illustrative embodiment, the invention is a system for controlling an oscillatory penetration apparatus, said sonic penetration apparatus being subjected to an oscillatory input force waveform at an input force location and vibrating in accordance with an oscillatory response waveform, said system comprising: means for driving the oscillatory penetration apparatus; means for measuring a response of the oscillatory penetration apparatus; means for controlling the oscillatory penetration apparatus; and wherein said means for measuring a response measures at least a phase angle between the oscillatory input force waveform and the oscillatory response waveform. In one exemplary embodiment, the oscillatory response waveform is characterized by measuring an acceleration, a velocity, a displacement or a jerk at a measurement location on said oscillatory penetration apparatus that characterizes said response at said input force location. In another exemplary embodiment, said means for controlling the oscillatory penetration apparatus comprises means for adjusting a push-pull force being imposed on the oscillatory penetration apparatus to produce a desired (e.g., a maximum achievable) penetration rate. In one exemplary embodiment, the efficiency of the oscillatory penetration apparatus is maximized by operating the oscillatory penetration apparatus at a phase angle between the oscillatory input force waveform and the oscillatory acceleration waveform of about +90 degrees. In one exemplary embodiment, the efficiency of the oscillatory penetration apparatus is maximized by operating the oscillatory penetration apparatus at a phase angle between the oscillatory input force waveform and the oscillator velocity waveform of about zero degrees. In one exemplary embodiment, the efficiency of the oscillatory penetration apparatus is maximized by operating the oscillatory penetration apparatus at a phase angle between the oscillatory input force waveform and the oscillator displacement waveform of about −90 degrees. In one exemplary embodiment, the efficiency of the oscillatory penetration apparatus is maximized by operating the apparatus at a phase angle between the oscillatory input force waveform and the oscillator jerk waveform of about +180 degrees or −180 degrees.

In another illustrative embodiment, the invention is a sonic drill control system comprising: a hydraulic pump that pressurizes a hydraulic fluid; a diesel engine that drives said hydraulic pump; a sonic drill comprising a drill string and a driver comprising an eccentric that produces an oscillatory input force waveform, said sonic drill apparatus being operative to produce an oscillatory response waveform; a driver sensor that is operative to sense said oscillatory response waveform; an eccentric hydraulic motor that drives said eccentric; an eccentric hydraulic valve that controls the amount or pressure of said hydraulic fluid introduced to said eccentric hydraulic motor; an eccentric pressure sensor that senses the pressure of said hydraulic fluid introduced to said eccentric hydraulic motor; an eccentric sensor that senses the rate of rotation of said eccentric; a rotation hydraulic motor that rotates said drill string; a rotation hydraulic valve that controls the amount or pressure of said hydraulic fluid introduced to said rotation hydraulic motor; a rotation pressure sensor that senses the pressure of said hydraulic fluid introduced to said rotational hydraulic motor; a rotary sensor or rotation sensor that senses the rate of rotation of said drill string; a hydraulic piston or push-pull piston comprising a push mechanism and a pull mechanism; a push-pull hydraulic valve that controls the amount or pressure of said hydraulic fluid introduced to said hydraulic piston or push-pull piston; a pull pressure sensor that senses the pressure of said hydraulic fluid introduced to said pull mechanism; a push pressure sensor that senses the pressure of said hydraulic fluid introduced to said push mechanism; a push-pull position sensor that senses the position of said drill string; and a programmable logic controller that accepts input from said sensors, analyzes said input and sends output to said valves; wherein said programmable logic controller is operative to determine a phase angle between said oscillatory input force waveform and said oscillatory response waveform. The sonic drill control system may further comprise: a frame; and a pneumatic, spring for supporting said sonic drill and isolating sonic drill vibrations from said frame; said pneumatic spring being operative to change the resonant frequency of said sonic drill. The sonic drill control system may further comprise: a signal conditioning board for converting raw signals produced by at least some of said sensors into usable signals.

In another embodiment, the invention is a control system for a sonic drill apparatus, said sonic drill apparatus comprising components including a drill rig or frame, a sonic head comprising excitation means (e.g., eccentrics) that vibrate in accordance with an oscillatory input force waveform, a drill string that vibrates in accordance with an oscillatory displacement waveform and a drill bit, said control system comprising: means for driving the sonic drill apparatus (e.g., by hydraulic fluid having a pressure and a flow rate to drive the eccentrics, or electricity to drive the electric motors to drive the eccentrics); means for measuring a response of the sonic drill apparatus (e.g., an accelerometer, a displacement sensor, a velocity sensor, a strain sensor, non-contact sensors or visual sensors and an electrical circuit or computer that compares a first signal from said means for driving the sonic drill apparatus to a second signal characterizing the response of the sonic drill and determines the phase angle between the two signals); and means for establishing an operating state of the sonic drill apparatus (e.g., switches, buttons, human machine interface to indicate to the control system what operating state is desired); wherein said means for measuring a response measures at least a phase angle between the oscillatory input force waveform and the oscillatory displacement waveform. In another embodiment, said means for driving the sonic drill apparatus is selected from the group consisting of: means for imposing a rate of rotation on a rotatable component of the sonic drill apparatus (e.g., a hydraulic motor or an electric motor); means for imposing a push-pull force on the drill string (e.g. a hydraulic cylinder, a chain or cable, gravity, a pneumatic cylinder, or a magnetic or electrical means for imposing force); means for imposing a rotational torque on the drill string or the drill bit (e.g., a hydraulic piston, a hydraulic motor, a pneumatic piston, a pneumatic motor, an electric rotary motor, an electric linear motor, a linear servo motor, a voice coil or a piezoelectric actuator); means for imposing an input force frequency on the eccentrics (e.g. a hydraulic pressure, a hydraulic flow rate, an electric voltage, an electric current, a pneumatic pressure or a pneumatic flow rate); means for imposing an input force amplitude by the eccentrics onto the drill string (e.g. a hydraulic pressure, a hydraulic flow rate, an electric voltage, an electric current, a pneumatic pressure or a pneumatic flow rate); means for imposing an input torque on the eccentrics (e.g., a hydraulic rotary motor or an electric rotary motor); and means for imposing a coupling rate between the sonic head and the drill rig or frame (e.g., a pneumatic spring, rubber-like material mounts, or conventional springs).

In one embodiment, said means for measuring a response of the sonic drill apparatus is selected from the group consisting of: means for measuring a rate of penetration (e.g., a displacement sensor, a distance measurement or a rotary encoder encoding drill string displacement); means for measuring a power utilization (e.g., an electric circuit that measures the mechanical power input to the apparatus and the actual mechanical work being done by the apparatus); means for measuring a power efficiency (e.g., an electrical system that divides the actual mechanical power output by the mechanical power input and multiplies this ratio by 100 percent); means for measuring a power factor (e.g., an electrical system that divides the actual mechanical power output by the mechanical power input; means for measuring a sound pressure (e.g. a microphone); means for measuring a sound intensity (e.g., a microphone and a electrical system that is operative to take the root mean square of the sound signal and convert it into the decibel scale); means for measuring a phase difference between the oscillatory input force waveform and a measured value that characterizes the oscillatory displacement waveform (e.g., an electrical circuit that compares a first signal from said means for driving the sonic drill apparatus and a second signal characterizing a response of the sonic drill apparatus and determines the phase angle between the two signals); and means for characterizing the oscillatory displacement waveform (e.g., an accelerometer, a displacement sensor, a velocity sensor, a strain sensor, a non-contact sensor or a visual sensor that is operative to produce a signal in combination with an electrical system to convert the signal to the displacement waveform).

In one embodiment, said means for establishing an operating state of the sonic drill apparatus is selected from the group consisting of: means for establishing a maximum penetration efficiency (e.g., a control system that is operative to establish a power factor of about one or an electrical system or computer that is operative to divide the penetration rate by the power consumed while the apparatus is operating at a resonant condition); means for establishing a maximum penetration rate (e.g., a control system that is operative to systematically adjust the input force amplitude, forcing frequency, rate of rotation and/or push or pull amplitude and/or direction until the maximum penetration rate is achieved); means for establishing a maximum drill string acceleration amplitude or a specific drill string acceleration amplitude (e.g., a control system that is operative to find the mechanical resonant frequency of the apparatus and then increase the input force frequency until the desired acceleration is reached or the maximum acceleration amplitude is reached); means for establishing a maximum drill string velocity amplitude or specific drill string velocity amplitude (e.g., a control system that is operative to find the mechanical resonant frequency of the apparatus and then increase the input force frequency until the desired velocity is reached or the maximum velocity amplitude is reached); means for establishing a maximum drill string displacement amplitude or specific drill string displacement amplitude (e.g., a control system that is operative to find the mechanical resonant frequency of the apparatus and then increase the input force frequency until the desired displacement amplitude is reached or the maximum displacement amplitude is reached); and means for establishing a maximum drill string jerk amplitude or specific drill string jerk amplitude (e.g., a control system that is operative to find the mechanical resonant frequency of the apparatus and then increase the input force frequency until the desired jerk amplitude is reached or the maximum jerk amplitude is reached).

In one embodiment, the oscillatory displacement waveform is characterized by measuring an acceleration, a velocity, a displacement or a jerk at a location on said sonic drill apparatus that characterizes said response at an input force location. In another embodiment, said rate of rotation is a speed at which the drill string is rotating relative to the drill head, a speed at which the drill bit is rotating relative to the drill head, or a speed at which the drill bit is rotating relative to the drill string. In another embodiment, said means for imposing a push-pull force on the drill string is selected from the group consisting of: a hydraulic cylinder, a chain or cable, gravity, a pneumatic cylinder, and a magnetic or electrical means for imposing force. In another embodiment, said means for imposing an input force amplitude on the eccentrics or the drill string is selected from the group consisting of: a hydraulic piston, a hydraulic motor, a pneumatic piston, a pneumatic motor, an electric rotary motor, an electric linear motor, a linear servo motor, a voice coil and a piezoelectric actuator. In another embodiment, an output of said means for imposing an input force amplitude on the eccentrics or the drill string is modified by adjusting a hydraulic pressure, a hydraulic flow rate, an electric voltage, an electric current, a pneumatic pressure, and a pneumatic flow rate.

In a further embodiment, the invention is a control system for a sonic drill apparatus, said sonic drill apparatus comprising components including a drill rig or frame, a sonic head comprising means for imposing an input force that vibrate in accordance with an oscillatory input force waveform, a part that vibrates in accordance with an oscillatory displacement waveform and a drill bit, said control system comprising: means for driving the sonic drill apparatus; means for measuring a response of the sonic drill apparatus; and means for establishing an operating state of the sonic drill apparatus; wherein said means for measuring a response measures at least a phase angle between the oscillatory input force waveform and the oscillatory displacement waveform. In one embodiment, said phase angle is about minus ninety degrees. In another embodiment, the control system further comprises: means for detecting whether the control system is operating in an unsafe operating condition (e.g., an electrical system that is operative to analyze the response of the sonic drill apparatus and use predefined equations to calculate safe operating conditions and compare the safe operating conditions with the actual response of the apparatus).

In a further embodiment of the invention, the control system of claim 13 wherein said means for detecting is selected from the group consisting of: means for detecting when decoupling between said drill bit and said drilling media is occurring (e.g., an electrical system that is operative to detect rapid changes in the response of the sonic drill apparatus while also being operative to detect a rapid increase in response amplitude); means for detecting when the part is over stressed (e.g., an electrical system that is operative to analyze the response of the sonic drill apparatus and to use predefined equations to calculate safe operation conditions and compare the results of those calculations with the actual response of the apparatus, with the apparatus response being broken down into local part responses and with each part stress being found and compared with the calculated safe stress levels, recognizing that if the part local stress is greater than the safe stress limit, the part is over stressed); means for detecting when said means for measuring a response of the sonic drill apparatus is inoperative (e.g., a voltage sensing circuit that is operative to confirm that an electrical load is occurring and that an actual signal is being read correctly); and means for detecting when said means for driving the sonic drill apparatus is not under control (e.g., an encoder on the rotating eccentrics that is operative to give feedback to the controller and if the control system is not able to correct the miss-match between the actual encoder position and the target position, the driver is no longer under control.) In another embodiment, the part is a drill string.

In another embodiment, the invention is an oscillatory penetration apparatus, said oscillatory penetration apparatus comprising components including a frame, a sonic head comprising means for imposing an input force that vibrate in accordance with an oscillatory input force waveform, and a part that vibrates in accordance with an oscillatory displacement waveform, said oscillatory penetration apparatus comprising: means for driving the oscillatory penetration apparatus; means for measuring a response of the oscillatory penetration apparatus; and means for controlling the oscillatory penetration apparatus; wherein said means for measuring a response measures at least a phase angle between the oscillatory input force waveform and the oscillatory displacement waveform. In one embodiment, the part is selected from the group consisting of: a pile; a drill bit; a coring bit; a horn; a free mass; a drill stem; and a drill pipe. In another embodiment, said means for controlling the oscillatory penetration apparatus is selected from the group consisting of: an electric circuit; a mechanical system; a personal computer; a programmable logic controller; and a microcontroller.

In a further embodiment, the invention is an apparatus comprising: a member that is operative to perform a linear vibration, said linear vibration having an oscillating displacement waveform; means for applying an oscillating input force to said member, said oscillating input force having a an oscillating input force waveform having a frequency; means for applying a non-oscillating push-pull force to said member, said non-oscillating, push-pull force having a magnitude and a direction; and means for controlling said frequency, said magnitude and said direction; wherein said means for controlling being operative to detect whether said member is moving excessively and being operative to measure at least a phase angle between the oscillatory input force waveform and the oscillatory displacement waveform.

In another embodiment, the invention is a method for controlling a sonic drill having a displacement and an operating range and operating at a phase angle (e.g., a phase angle between an input force waveform and a displacement waveform, a velocity waveform, an acceleration waveform or a jerk waveform), said sonic drill comprising a push-pull piston and eccentrics, said method comprising: operating the push-pull piston at an initial push-pull force while the eccentrics are operated at a plurality of different operating frequencies within the operating range of the sonic drill and measuring the displacement at each operating frequency; determining an efficient operating frequency for the material being drilled and operating the eccentrics at said efficient operating frequency; determining the phase angle at which the sonic drill is operating; and if the phase angle is not substantially equal to minus ninety degrees, operating the push-pull piston at another push-pull force.

In a further embodiment, the invention is a method comprising: applying an oscillating input force to a member, said oscillating input force having an oscillating input force waveform having a frequency, said member performing a linear vibration in response to said oscillating input force, said linear vibration having an oscillating response (e.g., displacement) waveform; applying a non-oscillating push-pull force to said member, said non-oscillating, push-pull force having a magnitude and a direction; detecting whether said member is vibrating excessively and measuring at least a phase angle between the oscillatory input force waveform and the oscillatory response (e.g., displacement) waveform; and controlling said frequency, said magnitude and said direction.

In another embodiment, the invention is a method for controlling a sonic drill apparatus, said sonic drill apparatus comprising components including a drill rig or frame, a sonic head comprising one or more pairs of eccentrics that vibrate in accordance with an oscillatory input force waveform, a drill string that vibrates in accordance with an oscillatory displacement waveform and a drill bit, said control system comprising: driving the sonic drill apparatus; measuring a response of the sonic drill apparatus; and establishing an operating state of the sonic drill apparatus; wherein measuring a response comprises measuring at least a phase angle between the oscillatory input force waveform and the oscillatory displacement waveform.

In another embodiment, the invention is a method for controlling a sonic drill having a displacement and an operating range and operating at a phase angle, said sonic drill comprising a push-pull piston and eccentrics, said method comprising: a step for operating the push-pull piston at an initial push-pull force while the eccentrics are operated at a plurality of different operating frequencies within the operating range of the sonic drill and measuring the displacement at each operating frequency; a step for determining an efficient operating frequency for the material being drilled and operating the eccentrics at said efficient operating frequency; a step for determining the phase angle at which the sonic drill is operating; and if the phase angle is not substantially equal to minus ninety degrees, a step for operating the push-pull piston at another push-pull force.

In a further embodiment, the invention is a method comprising: a step for applying an oscillating input force to a member, said oscillating input force having an oscillating input force waveform having a frequency, said member performing a linear vibration in response to said oscillating input force, said linear vibration having an oscillating displacement waveform; a step for applying a non-oscillating push-pull force to said member, said non-oscillating, push-pull force having a magnitude and a direction; a step for detecting whether said member is vibrating excessively and measuring at least a phase angle between the oscillatory input force waveform and the oscillatory displacement waveform; and a step for controlling said frequency, said magnitude and said direction.

In another embodiment, the invention is a method for controlling a sonic drill apparatus, said sonic drill apparatus comprising components including a drill rig or frame, a sonic head comprising eccentrics that vibrate in accordance with an oscillatory input force waveform, a drill string that vibrates in accordance with an oscillatory displacement waveform and a drill bit, said control system comprising: a step for driving the sonic drill apparatus; a step for measuring a response of the sonic drill apparatus; and a step for establishing an operating state of the sonic drill apparatus; wherein measuring a response comprises measuring at least a phase angle between the oscillatory input force waveform and the oscillatory displacement waveform.

In another embodiment, the invention is a method for controlling a sonic drill apparatus, said sonic drill apparatus comprising components including a drill rig or frame, a sonic head comprising eccentrics that vibrate in accordance with an oscillatory input force waveform, a drill string that vibrates in accordance with an oscillatory displacement waveform and a drill bit, said control system comprising: a step for driving the sonic drill apparatus; a step for measuring a response of the sonic drill apparatus; and a step for establishing an operating state of the sonic drill apparatus; wherein said step for measuring a response comprises a step for measuring at least a phase angle between the oscillatory input force waveform and the oscillatory displacement waveform.

In another embodiment, the invention is a system for controlling a sonic drill having a displacement and an operating range and operating at a phase angle, said sonic drill comprising a push-pull piston and eccentrics, said system comprising: means for operating the push-pull piston at an initial push-pull force while the eccentrics are operated at a plurality of different operating frequencies within the operating range of the sonic drill and measuring the displacement at each operating frequency; means for determining an efficient operating frequency for the material being drilled and operating the eccentrics at said efficient operating frequency; means for determining the phase angle at which the sonic drill is operating; and means for operating the push-pull piston at another push-pull force if the phase angle is not substantially equal to minus ninety degrees.

In a further embodiment, the invention is a system comprising: means for applying an oscillating input force to a member, said oscillating input force having an oscillating input force waveform having a frequency, said member performing a linear vibration in response to said oscillating input force, said linear vibration having an oscillating displacement waveform (e.g., a plurality of counter-rotating eccentrics, a hydraulic piston or a pneumatic piston acting on a drill pipe, a rod, a pile, a drill bit, a coring bit, a horn, a free mass or a drill stem); means for applying a non-oscillating push-pull force to said member, said non-oscillating, push-pull force having a magnitude and a direction (e.g. a hydraulic cylinder, a chain or cable, gravity, a pneumatic cylinder or magnetic or electrical means for imposing force); means for detecting whether said member is vibrating excessively and measuring at least a phase angle between the oscillatory input force waveform and the oscillatory displacement waveform; and means for controlling said frequency, said magnitude and said direction (e.g., two pairs of counter rotating eccentrics, each pair is phased from each other to give a vertical force magnitude from zero to maximum amplitude, while the pairs of eccentrics counter rotate to give zero lateral force and a linear voice coil, a piezoelectric device, a hydraulic piston or a pneumatic piston energized by varying the voltage or pressure to control the amount of force or controlling the frequency by reversing the voltage or pressure imposed on the apparatus).

In a further embodiment, the invention is a system for controlling a sonic drill apparatus, said sonic drill apparatus comprising components including a drill rig or frame, a sonic head comprising eccentrics that vibrate in accordance with an oscillatory input force waveform, a drill string that vibrates in accordance with an oscillatory displacement waveform and a drill bit, said control system comprising: means for driving the sonic drill apparatus; means for measuring a response of the sonic drill apparatus; and means for establishing an operating state of the sonic drill apparatus; wherein said means for measuring a response comprises means for measuring at least a phase angle between the oscillatory input force waveform and the oscillatory displacement waveform.

In another embodiment, the invention is a system for automatic control of an oscillatory penetration apparatus, said oscillatory penetration apparatus comprising a driver that is operative to produce an oscillatory input force waveform and a drill stem having an oscillatory displacement waveform, said system comprising: means for detecting a phase difference between the oscillatory input force waveform and the oscillatory displacement waveform; and means for using said phase difference to control the frequency of said oscillatory input force waveform (e.g. a control system that is operative to decrease or increase the frequency if the phase difference is not equal to negative ninety degrees by generating control signals). In one embodiment, the oscillatory penetration apparatus further comprises a drill rig that is operative to produce a push-pull force and said system further comprises: means for using said phase difference to control the magnitude and direction of a push-pull force (e.g., a control system that is operative to adjust the push-pull force drive signal to a push-pull force actuator).

In another preferred embodiment, the invention is a method for controlling an oscillatory penetration apparatus, said oscillatory penetration apparatus having a part that is being subjected to an oscillating force that has a frequency and an amplitude and that is being subjected to a push-pull force having a magnitude, said method comprising: performing a safety control process comprising: accepting data characterizing the oscillatory penetration apparatus; manipulating said data to determine a maximum safe amplitude of oscillations of the oscillatory penetration apparatus; sensing an actual amplitude of oscillations of the oscillatory penetration apparatus during its operation; determining if a ratio of said actual oscillations to said maximum safe amplitude is greater than one; if said ratio is greater than one, shutting down the oscillatory penetration apparatus; if the ratio is not greater than one, determining if the ratio is greater than a preselected value of about 0.8 (recognizing that this preselected value is system dependent, e.g., on the time constant, drive method, and control method for the apparatus and thus 0.8 may not be appropriate for all systems) or is running away; if the ratio is not greater than about said preselected value (e.g., 0.8) and is not running away, then allowing the oscillatory penetration apparatus to operate normally; and if the ratio is greater than said preselected value (e.g., about 0.8) or is running away, then adjusting the frequency, adjusting the push-pull force and/or adjusting the amplitude to reduce said ratio of said actual oscillations to said maximum safe amplitude; and/or performing a normal control process comprising: (1) accepting data characterizing the oscillatory penetration apparatus; (2) performing a frequency sweep; (3) determining an optimum resonant operating point for said oscillatory penetration apparatus and logging resonant frequencies; (4) setting an input force frequency that is higher than said optimum resonant operating point; (5) adjusting said input force frequency down to produce a phase lag; (6) testing whether said phase lag between said input force waveform and a displacement waveform of −90 degrees has been achieved, and if a phase lag of −90 degrees has been achieved, going to step (14); (7) if a phase lag of −90 degrees has not been achieved, decreasing the magnitude of the push-pull force to produce a second phase lag; (8) retesting said phase lag, and if said phase lag of −90 degrees has been achieved, going to step (14); (9) if said phase lag of −90 degrees has still not been achieved, determining whether the magnitude of the push-pull force is greater than zero, and if the magnitude of the push-pull force is greater than zero, going to step (14); (10) if the magnitude of the push-pull force is not greater than zero, increasing the push force; (11) checking said phase lag, and if said phase lag of −90 degrees has been achieved, going to step (14); (12) determining whether a penetration rate is negative, and if said penetration rate is negative, going to step (13); (13) adjusting said input force frequency to another resonant frequency and going to step (4); (14) adjusting a rate of rotation, said push-pull force magnitude and/or direction, said input force amplitude (if applicable), a flushing fluid flow rate (if applicable), and/or said input force frequency to achieve a maximum penetration rate; (15) rechecking whether said phase lag can be achieved while said maximum penetration rate is achieved, and if not going to step (4); and (16) if said phase lag can be achieved while said maximum penetration rate is achieved, operating at constant conditions until stopping is necessary.

Further aspects of the invention will become apparent from consideration of the drawings and the ensuing description of exemplary embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate some exemplary embodiments of the invention. In the drawings.

Figure 1:
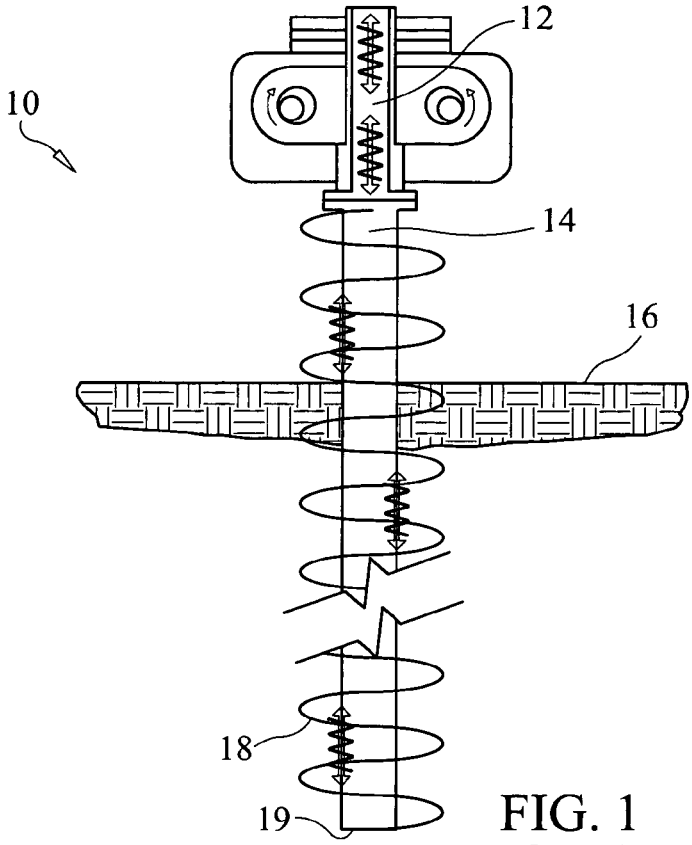
FIG. 1 PRIOR ART
FIG. 1 is a schematic cross-sectional diagram of a background art sonic drill.

The following reference numerals are used to indicate the parts and environment of the invention on the drawings:

10 background art sonic drill
12 sonic drill head, sonic driver
14 drill steel, drill string
16 ground
18 standing waves
19 drill tip, drill bit
20 single degree of freedom mechanical system, mechanical system
24 spring
26 damper
28 input force
30 displacement
40 free body diagram
50 single eccentric
60 pair of counter-rotating eccentrics, pair of eccentrics, eccentrics
80 sonic drill model
82 drill rig, frame
84 air spring
90 sonic drill free body diagram
100 drill string top boundary conditions
102 drill string tip boundary conditions
200 resonant sonic drill control system, sonic drill control system, control system
210 diesel engine, source
212 hydraulic pump
214 eccentric hydraulic valve
216 rotation hydraulic valve
218 push-pull hydraulic valve
220 eccentric hydraulic motor
222 rotation hydraulic motor
224 hydraulic piston, push-pull hydraulic piston
226 sonic drill apparatus, sonic drill

230 eccentric pressure sensor
232 eccentric pressure sensor
234 pull pressure sensor
236 push pressure sensor
240 driver sensor, drive sensor
242 rotary sensor or rotation sensor
244 push-pull position sensor
250 eccentric sensor, eccentric speed sensor
252 signal conditioning board
254 programmable logic controller, PLC, controller
260 user interface, human machine interface
270 resonant sonic drill control process, control process
272 initiate process control step
274 sweep frequencies step
276 set frequency step
278 track phase step
280 adjust push-pull force step
290 eccentric speed feedback loop
292 eccentric speed comparison point
300 push-pull force feedback loop
302 push-pull comparison point
390 safety control process
400 input data step
402 calculate maximum safe operation condition step
404 monitor apparatus step
406 compare amplitudes step
408 shut down unsafe apparatus step
410 record unsafe conditions step
412 retest conditions step
414 apply control actions step
416 operate normally step
420 normal control process
422 perform frequency sweep step
424 determine optimum resonance operating point step
426 set input force frequency step
428 adjust input force frequency step
430 test phase difference step
432 decrease push-pull force step
434 retest phase difference step
436 test push-pull force magnitude step
438 increase push-pull force magnitude step
440 check phase difference step
442 determine penetration rate step
444 readjust input force frequency step
450 maximize penetration rate step
452 recheck phase difference step
456 operate at constant conditions step

DETAILED DESCRIPTION OF THE INVENTION

A resonating system has mechanical advantages which can be utilized to do highly useful work. This disclosure first introduces a generalized, single degree of freedom system, then the analysis is further expanded for application to improvement of a background art sonic drill.

Referring to FIG. 1, background art sonic drill 10 is shown. Background art sonic drill 10 comprises sonic drill head 12 and drill steel or drill string 14 which penetrates ground 16 when sonic drill 10 is in operation. Standing waves 18 are created in drill string 14 by sonic drill head 12.

A resonant system is said to be in resonance when the input power is being directly transferred to the damping of the system, without expending energy within the system itself. This occurs at particular frequencies where the inertial forces counter the stored energy forces generated by the motion. The resonant condition is best described as a single degree of freedom system, which is also referred to as a typical lumped parameter system.

Figure 2:
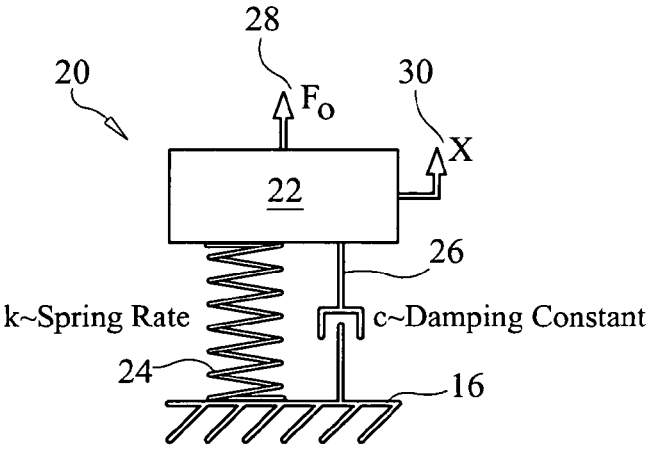
FIG. 2 is a schematic block diagram of a mechanical system having one degree of freedom.

Referring to FIG. 2, single degree of freedom mechanical system 20 is illustrated that comprises a single mass 22 that is connected to ground 16 by means of spring 24 and damper 26. In this embodiment, spring 24 has a spring constant 'k' that defines the spring's resultant force when compressed or elongated. Damper 26 has a damping constant 'c' associated with it that defines the resultant force when the damper is being compressed or elongated at some velocity. Mass 22 is subjected to input force 28 and travels displacement 30.

Figure 3:
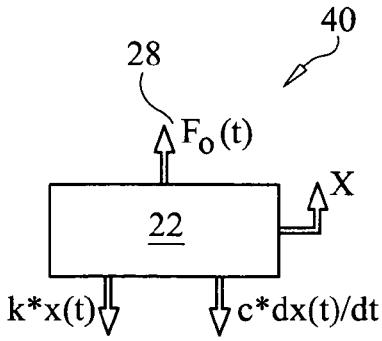
FIG. 3 is a schematic free body diagram of a mechanical system having one degree of freedom.

Referring to FIG. 3, a corresponding free body diagram 40 is shown for mechanical system 20 of FIG. 2. The governing differential equation (GDE) of motion, depicted in Equation 1, can be derived from Newton's second law of motion or force balance, shown by Equation 2.

$$\underbrace{m\cdot\frac{d^2}{dt^2}x(t)}_{\substack{Inertia\\Forces}}+\underbrace{c\cdot\frac{d}{dt}x(t)}_{\substack{Damping\\Forces}}+\underbrace{k\cdot x(t)}_{\substack{Stored\\Forces}}=\underbrace{F_o\cdot\sin(\omega_f\cdot t)}_{\substack{Input\\Forces}} \quad \text{Equation 1}$$

$$\sum F = m\cdot a \quad \text{Equation 2}$$

Newton's second law states that the force acting on an object is equal to its mass multiplied by its acceleration. The governing differential equation relates all the known system constants to the input force through the resultant motion of the system, 'x(t)'.

In one embodiment, input force 28 is sinusoidal, so the resultant motion solution x(t) is assumed also to be sinusoidal, as displayed in Equation 3, where 'X' is the displacement amplitude, '$\omega_f$' is the input forcing frequency, 't' is the time, and '$\Phi_d$' is the phase angle offset between the input forcing sinusoidal function and the displacement.

$$x(t)=X\cdot\sin(\omega_f t+\phi_d) \quad \text{Equation 3}$$

The assumed solution, Equation 3, is then placed into the governing differential equation (GDE), Equation 1, and the resulting manipulated GDE is shown in Equation 4. By examining Equation 4, it can be observed that there is a particular frequency at which the inertia forces, caused by the mass, directly offsets the stored force, exerted by spring 24.

$$\underbrace{-m\cdot X\cdot\omega_f^2\cdot\sin(\omega_f\cdot t+\phi_d)}_{\substack{Inertia\\Forces}}+\underbrace{c\cdot\omega_f\cdot X\cdot\cos(\omega_f\cdot t+\phi_d)}_{\substack{Damping\\Forces}}+ \quad \text{Equation 4}$$

$$\underbrace{k\cdot X\cdot\sin(\omega_f\cdot t+\phi_d)}_{\substack{Stored\\Forces}}=\underbrace{F_o\cdot\sin(\omega_f\cdot t)}_{\substack{Input\\Forces}}$$

This particular frequency is the undamped natural frequency '$\omega_n$' of single degree of freedom mechanical system 20 and can be found to be equal to the square root of the spring rate divided by the mass, as shown in Equation 5. At the undamped natural frequency '$\omega_n$' of mechanical system 20, the phase angle between the input force and the spring force is −90 degrees. Under this condition, the damping forces are in phase with the input forces.

$$\omega_n = \sqrt{\frac{k}{m}} \quad \text{Equation 5}$$

In order to examine a resonant system, the GDE must be solved and the solution must be analyzed. By applying trigonometric relations to the manipulated GDE, Equation 4, the displacement amplitude 'X' and phase angle '$\Phi_d$' are found, as displayed in Equation 6 and Equation 7, respectively. From these two relations, one may conclude that, if the damping constant is very large, then the damping effect overrides the inertia and spring effects and does not allow mechanical system 20 to utilize input force 28 to perform work.

$$X = \frac{F_o}{[(k - m\cdot\omega_f^2)^2 + c^2\cdot\omega_f^2]^{0.5}} \quad \text{Equation 6}$$

$$\phi_d = \tan^{-1}\cdot\left(\frac{c\cdot\omega_f}{k - m\cdot\omega_f^2}\right) \quad \text{Equation 7}$$

In other words, as the damping constant 'c' in Equation 8 gets larger, the displacement amplitude 'X' gets smaller. This allows less energy to be utilized by damper 26. An analogy to this may be expressed as follows: the larger the resister that is placed into an alternating current (AC) circuit, at constant voltage amplitude, the smaller the flow of electrons it allows, thus using less power through the resistor. In order to more easily quantify when damping takes control of mechanical system 20, a damping ratio '$\zeta$', displayed in Equation 8, is defined as the ratio of the damping constant 'c' to the critical damping value '$c_{cr}$'. The critical damping value '$c_{cr}$' is found to be the value of damping that does not allow the system to oscillate during a transient situation.

$$\zeta = \frac{c}{c_{cr}} = \frac{c}{2\cdot m\cdot\omega_n} \quad \text{Equation 8}$$

The transient vibration frequency '$\omega_d$' or damped natural frequency is found by the relation displayed in Equation 9. As the damping ratio approaches one, $\omega_d$ approaches zero.

$$\omega_d = \omega_n\cdot\sqrt{1-\zeta^2} \quad \text{Equation 9}$$

However, the damped natural frequency is not the frequency where the maximum displacement occurs for a forced system. By taking the derivative of the displacement amplitude, Equation 6, and solving for zero, the maximum displacement frequency '$\omega_M$', displayed in Equation 10, is found. $\omega_M$ is real only when $\zeta$ is greater than one half of the square root of two. If $\zeta$ is large enough so that $\omega_M$ is zero or imaginary, then X is maximized only at zero input frequency.

$$\omega_M = \omega_n\cdot\sqrt{1-2\cdot\zeta^2} \quad \text{Equation 10}$$

Figure 4:
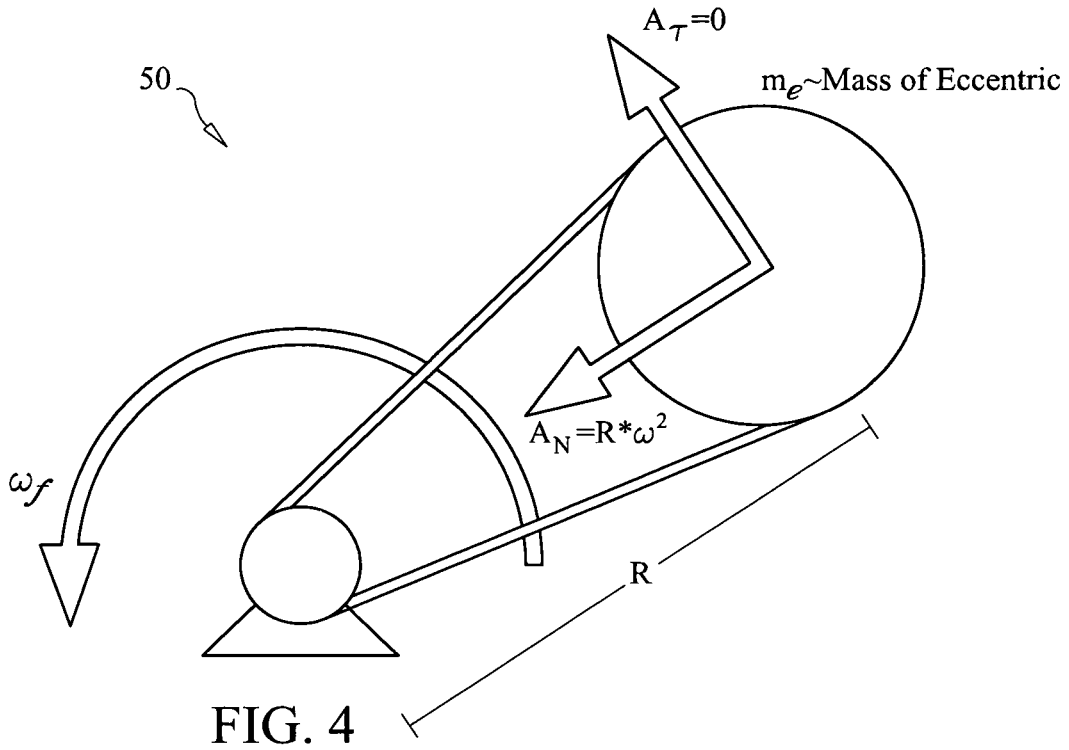
FIG. 4 is a schematic vector diagram of a rotating eccentric mass.

Background art sonic drills are powered by eccentric driven oscillators or eccentrics. A single eccentric 50 creates input force 28 in the direction outward from the axis of rotation through the eccentric mass as shown in FIG. 4. The force that is imposed onto the supporting structure equals the inward acceleration '$A_N$' multiplied by the eccentric mass '$m_e$', as shown in Equation 11.

$$F_{ecc} = m_e\cdot R\cdot\omega_f^2 \quad \text{Equation 11}$$

Figure 5:
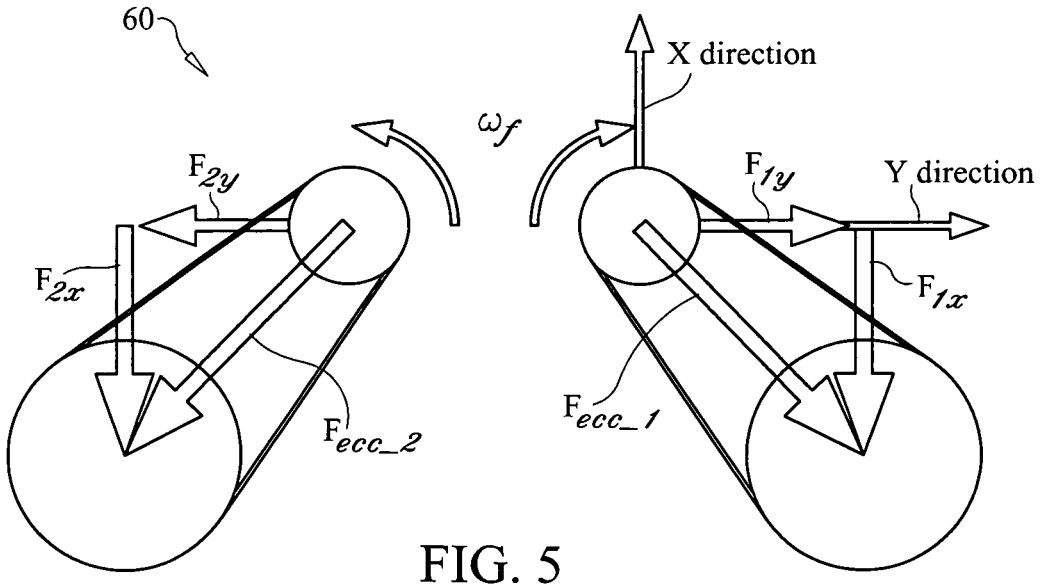
FIG. 5 is a schematic vector diagram of a pair of rotating eccentric masses.

The force vector revolves around the axis of rotation so that, in order to only have the force vector in a linear (axial) direction, a second force exerted by a second eccentric that is counter rotating, must be applied to the same supporting mass, thus cancelling out all unwanted lateral forces and reinforcing the desired axial forces. A pair of counter-rotating eccentrics 60 generate the two eccentric force vectors displayed in FIG. 5 and show how the axial forces in the X direction are reinforced, and the lateral forces in the Y direction are cancelled.

Because background art sonic drills are driven by a pair of eccentrics, the GDE changes to include the input force, Equation 12, as the force amplitude. By analyzing the same single degree of freedom mechanical system 20 displayed above in FIG. 2, with a similar forcing function, this equation gives an accurate representation of the sonic drill performance.

$$\underbrace{m\cdot\frac{d^2}{dt^2}x(t)}_{\text{Inertia Forces}} + \underbrace{c\cdot\frac{d}{dt}x(t)}_{\text{Damping Forces}} + \underbrace{k\cdot x(t)}_{\text{Stored Forces}} = \underbrace{m_e\cdot R\cdot\omega_f^2\cdot\sin(\omega_f\cdot t)}_{\text{Input Forces}} \quad \text{Equation 12}$$

A revised GDE with the eccentric input forcing function is displayed in Equation 13. With an eccentric driven system, the undamped natural frequency '$\omega_n$', damped natural frequency '$\omega_d$', phase angle '$\Phi_d$', and damping ratio '$\zeta$' are still found the same way as described above and have the same values. However, while the maximum displacement amplitude frequency '$\omega_M$', displayed in Equation 14, is also found the same way, it is now higher than the undamped natural frequency. As the damping ratio increases up to one divided by the root of two, the maximum amplitude natural frequency '$\omega_M$' goes to infinity.

$$\frac{d^2}{dt^2}x(t) + 2\cdot\zeta\cdot\omega_n\cdot\frac{d}{dt}x(t) + \omega_n^2\cdot x(t) = \frac{m_e\cdot R\cdot\omega_f\cdot\sin(\omega_f\cdot t)}{m} \quad \text{Equation 13}$$

The GDE can also be rewritten in terms of our damping ratio '$\zeta$' and undamped natural frequency '$\omega_n$', as displayed in Equation 14. This is done to ease the transition from the single degree of freedom system to the sonic drill.

$$\omega_M = \frac{\omega_n}{\sqrt{1-2\cdot\zeta^2}} \quad \text{Equation 14}$$

Figure 6A:
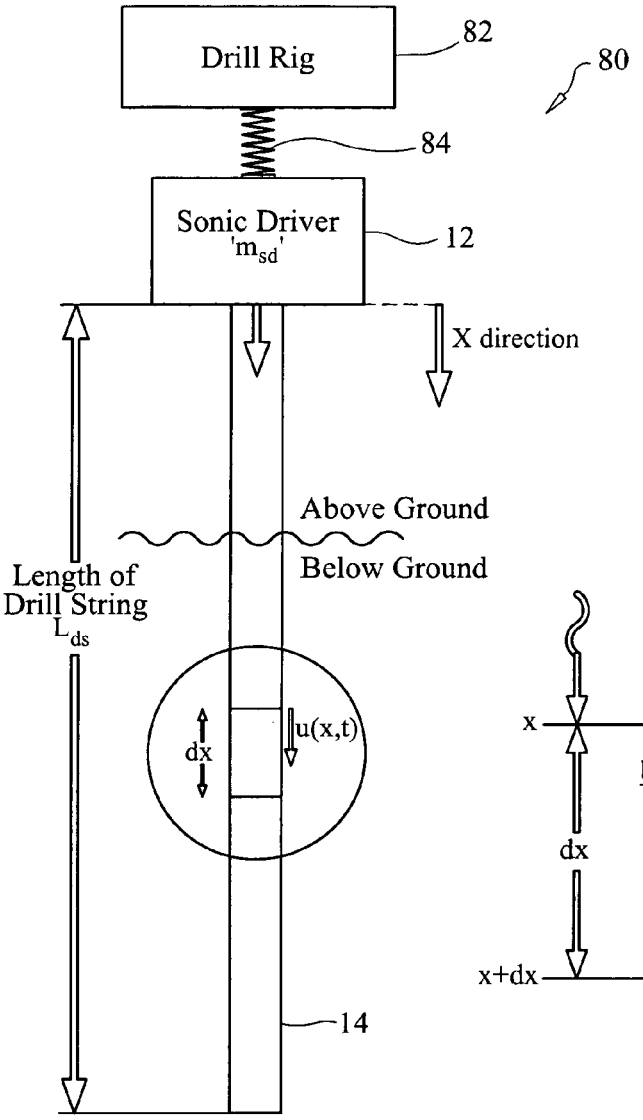
FIG. 6A is a schematic diagram of a sonic drill model in accordance with an embodiment of the invention.

A sonic drill is a different type of resonant system from the lumped parameter single degree of freedom mechanical system 20 covered above. However, by applying the tools described above, after the sonic drill GDE is formulated, the applicant discovered that a sonic drill behaves similarly to the single degree of freedom mechanical system described above. An embodiment of sonic drill model 80 is displayed in FIG. 6.

Figure 6B:
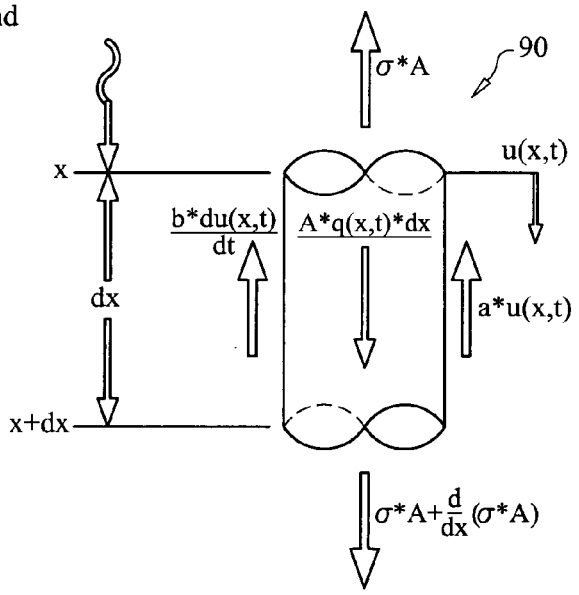
FIG. 6B is a schematic free body diagram of a portion of a drill string of the sonic drill model of FIG. 6A.

By analyzing sonic drill model 80, sonic drill free body diagram 90, as displayed in FIG. 6B, can be prepared. Then, by applying Newton's second law of motion to the free body diagram, the governing differential equation can be derived, as shown in Equation 15. The damping forces are imposed by the ground materials along the length of drill string 14. The stored forces are caused by the internal stiffness of drill string 14 and the coupling between the ground material being drilled and drill string 14 along the length of drill string 14. The input forces are any forces applied to the body along drill string 14 and, for this problem there are none. The inertial forces are caused by the mass of drill string 14 and the local accelerations of drill string 14.

The solution to this problem is the deflection along the length of drill string 14 relative to time, u(x,t). The damping constant 'b' and the spring constant 'a' of the soil are functions of the soil shear modulus of elasticity '$G_s$', soil density '$\rho_s$', cross sectional area of the drill pipe 'A', drill pipe surface perimeter 'P', geometry ratio of the pipe '$r_g$', and the density of the pipe 'ρ'. The geometry ratio is the ratio of the cross sectional area of the drill pipe with respect to the drill pipe surface perimeter squared, as shown in Equation 16. The damping and spring constants of the soil are found by the relations shown in Equations 17 and 18, respectively.

$$\underbrace{\rho * A * dx * \frac{\partial^2 u(x,t)}{\partial t^2}}_{\substack{Inertia\\Forces}} + \underbrace{2 * b * A * dx * \frac{\partial u(x,t)}{\partial t}}_{\substack{Damping\\Forces}} + \left(a * A * dx * \underbrace{u(x,t) - E * A * dx * \frac{\partial^2 u(x,t)}{\partial x^2}}_{\substack{Stored\\Forces}}\right) = \underbrace{q(x,t) * A * dx}_{\substack{Input\\Forces}} \quad \text{Equation 15}$$

$$r_g = \frac{A}{P^2} \quad \text{Equation 16}$$

$$b = \frac{\sqrt{\frac{G_s * \rho_s}{A * r_g}}}{2 * \rho} \quad \text{Equation 17}$$

$$a = \frac{\pi * G_s}{\rho * A} \quad \text{Equation 18}$$

The GDE for sonic drill model 80 is manipulated and transformed from the time domain into the Fourier domain and then into the Laplace domain, as displayed in Equation 19. Then, by applying the same tools used above to define the damping ratio 'ζ' for the single degree of freedom, the damping ratio 'γ' can be defined for sonic drill model 80, as shown in Equation 20.

$$s^2 + 2 \cdot b \cdot s + c^2 \cdot \theta^2 + a = F_o \quad \text{Equation 19}$$

$$\gamma = \frac{b}{\sqrt{c^2 \cdot \theta^2 + a}} \quad \text{Equation 20}$$

The GDE for the sonic drill can then be rewritten with the damping ratio 'γ', as displayed in Equation 21. This equation is of the same form as the single degree of freedom mechanical system 20 expressed by Equation 13, above.

$$s^2 + 2 \cdot \gamma \cdot \omega_L \cdot s + \omega_L^2 = F_O \quad \text{Equation 21}$$

Because the sonic drill GDE shares the same form as the single degree of freedom mechanical system 20, the same measurement techniques and control techniques can also be used for the sonic drill. This is an important discovery, because the sonic drill is very complex and would normally need a very complex control algorithm and an assortment of measurement equipment to fully characterize it. But, because the GDE has been manipulated into a useful equation that allows the use of measurable quantities, such as the phase angle '$\Phi_d$', the sonic drill can be characterized and monitored during the drilling process. This eliminates the need for other sensors below the ground. This simplification is possible because drill string 14 is a continuous system, which relates the below ground information to the sensors above ground. The relation between the single degree of freedom mechanical system 28 and the sonic drill model 80 allows for the control system disclosed herein to monitor the ground conditions and adjust the sonic drill to its optimum operating conditions.

The effects of the material along the sides of drill string 14 are small compared to the damping on drill tip 19 because the primary mode of vibration is in a shear plane that attenuates the damping and restoring effects of the drilled side material. Drill string 14 does, however, expand and contract due to the Poisson effect; but this is a much smaller factor than the main axial mode. Because drill bit 19 is oriented in the direction of the primary mode, it exhibits the majority of the damping. Also, the soil has a natural frequency below 20 Hertz (Hz) and sonic drills operate mainly between 60 and 200 Hz. Because of this mismatch of frequencies, the ground does not transmit sonic energy because it fails to couple with drill string 14. Because this damping is very low, the sonic drill operator has to be very careful not to overstress drill string 14 at resonance when drill tip 19 is not engaged in drilling.

A sonic drill motion solution, displayed in Equation 22, is a function of both the length 'x' along drill string 14 and time 't'. It is also in the same form as the sinusoidal input force (input forcing function), shown in Equation 23.

$$u(x,t) = (A_O \cdot \sin(\theta_f x) + B_O \cdot \cos(\theta_f x)) \cdot (C_O \cdot \sin(\omega_f t) + D_O \cdot \cos(\omega_f t)) \quad \text{Equation 22}$$

$$F_{ecc} \cdot \sin(\omega_f t) \quad \text{Equation 23}$$

The 'x' radial frequency '$\theta_f$' with respect to the length 'x' along drill string 14 is related to the forcing angular frequency '$\omega_f$' by the relation depicted by Equation 24, that shows that the square of the ratio between '$\omega_f$' and '$\theta_f$' is equal to the Young's Modulus '$E_{ds}$' of drill string 14 divided by the density '$\rho_{ds}$' of drill string 14.

$$\frac{\omega_f^2}{\theta_f^2} = c^2 = \frac{E_{ds}}{\rho_{ds}} \quad \text{Equation 24}$$

Figure 7:
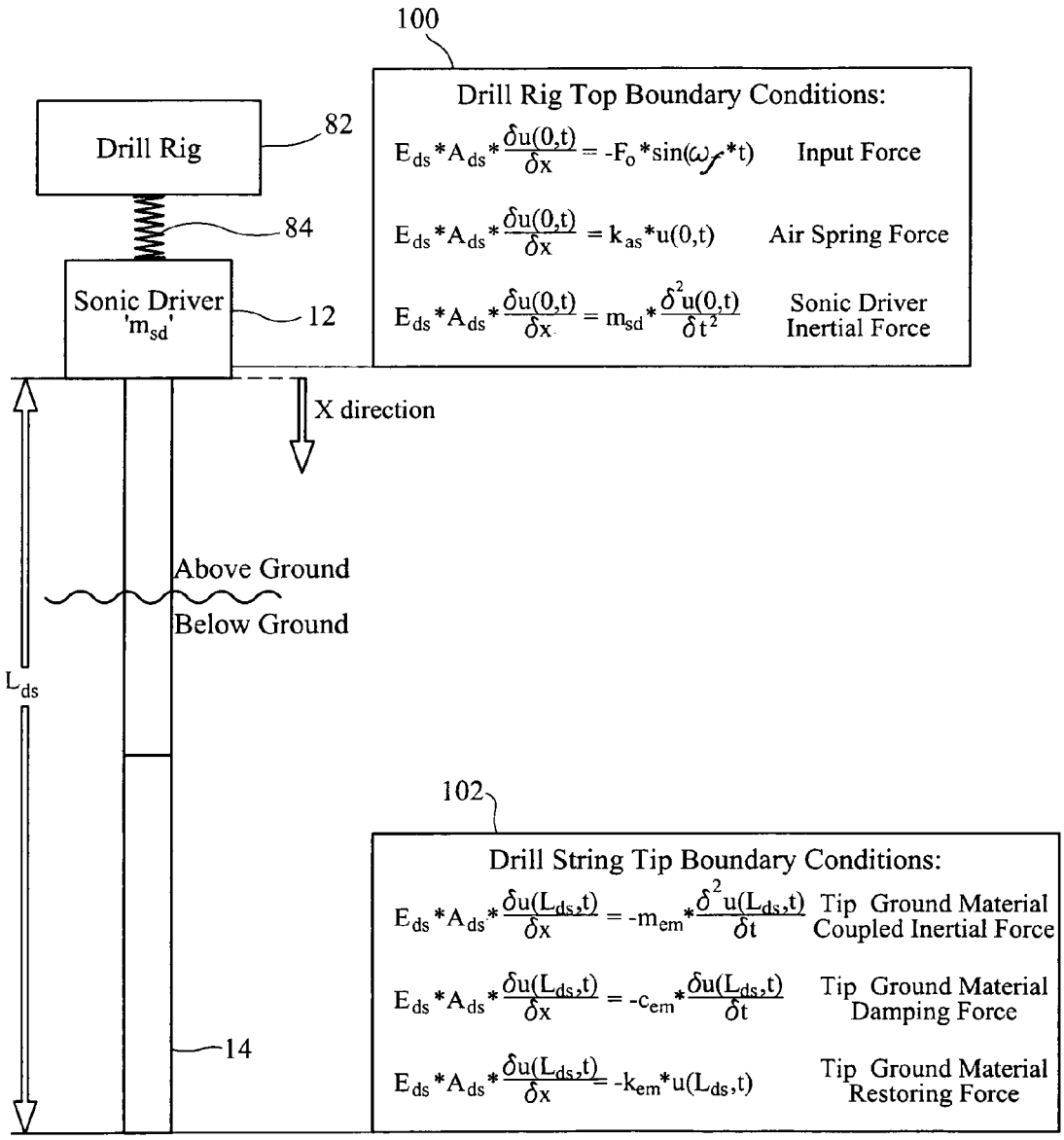
FIG. 7 is a schematic diagram of the sonic drill model of FIG. 6A showing drill string top and drill string tip boundary conditions in accordance with an embodiment of the invention.

In order to solve this problem and find the unknown coefficients '$A_o$, $B_o$, $C_o$, and $D_o$' of a solution, the boundary conditions for the sonic drill must be defined. An example of such boundary conditions are presented in FIG. 7. In this embodiment, the sonic driver mass, the input force from the sonic driver, and the air spring all reside at the location where 'x' is equal to zero (drill string top). In this embodiment, the sonic driver mass and the air spring are always boundary conditions, however, the input force may either be a boundary condition or an input into the sonic drill GDE as q(0,t).

All the boundary conditions are located on the ends of drill string 14, and because of this, all the conditions have to equal the apparent forces at the ends. For example, at drill tip 19, where x is equal to length of the drill string '$L_{ds}$', there exists the boundary condition caused by coupling drill tip 19 to the material being drilled. The forces for the ends of drill string 14 are found by taking the drill string's elastic constant '$E_{ds}$' multiplied by the cross sectional area of the drill string '$A_{ds}$' and also multiplied by the partial derivative of the local deflection with respect to the location in space 'x' and setting this equal to the boundary condition, as displayed in Equation 25.

$$E_{ds} * A_{ds} * \frac{\partial u(x, t)}{\partial x} = \text{Boundary_Condition} \quad \text{Equation 25}$$

Also, if drill string 14 were held in place at its ends, then the end condition would be fixed, making the local displacement always equal to zero, as displayed in Equation 26. For example, if drill string 14 is being pushed onto a rock formation before it is allowed to resonate, the end would act as if it were fused to the rock formation (and constitute a fixed end).

$$u(x,t)=0 \quad \text{Equation 26}$$

The other extreme occurs when drill string 14 is lifted off the bottom of the drilled hole so that drill tip 19 does not come into contact with any material; which constitutes a free end. However, the sonic drill would also be drilling into the material and thus interacting with it. The material could be very sandy and thus have little effective mass because it will be fluidized at drill tip 19. This sandy media would cause damping, but have no effective spring rate because of soil fluidization.

While drilling through rock formations, the effective mass of the material being drilled is insignificant as is the effective spring rate and damping. This is because the impacts with and brittle fracture of rock cause very little energy absorption and stored energy between the two, but drill string 14 is excited with all the higher frequency vibrations caused by the impacts.

Clays are the hardest and most complex materials to analyze because they have an "effective mass," have very high damping, and also have a spring rate. The spring rate is negligible compared to the rest of the system; however, the damping is not. In accordance with an embodiment of the invention, possible boundary conditions are displayed in Equation 27.

$$E_{ds} * A_{ds} * \frac{\partial u(0, t)}{\partial x} = -F_o * \sin(\omega_f * t) + k_{as} * u(0, t) + m_{sd} + \frac{\partial^2 u(0, t)}{\partial t^2} \quad \text{Equation 27}$$

Top Boundary Condition $$E_{ds} * A_{ds} * \frac{\partial u(L_{ds}, t)}{\partial x} = -m_{em} * \frac{\partial^2 u(L_{ds}, t)}{\partial t^2} - c_{em} * \frac{\partial u(L_{ds}, t)}{\partial t} - k_{em} * u(L_{ds}, t)$$

Tip Boundary Condition

The boundary conditions for both the driver (top) and bit (bottom or tip) ends of drill string 14 form two separate independent equations, as displayed in Equation 24. By placing the assumed solution, displayed in Equation 19, into the two independent boundary condition equations the unknown solution coefficients, '$A_o$, $B_o$, $C_o$, and Do', can then be determined. The four unknown coefficients can be determined with the two independent equations because each equation can be split into two independent equations where one includes the sine terms and the other includes the cosine terms, thus creating four independent equations for the four unknown coefficients. The top boundary condition includes the free condition on the left hand side of the equation and the input force, spring rate due to the air spring, and mass of the sonic driver. The pneumatic spring isolates the vibrations of the sonic drill from the supporting frame. The spring rate of the air spring changes with variations in air pressure. The variation in air pressure is controlled by auxiliary equipment such as controls, motors, pumps; valves, sensors, and engines. Because the air spring rate can change, apparatus dynamics can also change because the air spring is a part of the boundary conditions.

In order to take advantage of resonance in the sonic drilling process, it is necessary to not only understand the salient factors developed above, but the sonic drill is preferably instrumented so that it can be tracked and allow active feedback during the drilling process. These concepts relative to the disclosed technology, as well as the effects of the parameters that affect drilling system power requirements and complex interactive effects of mechanical forces on the drill string are presented below.

One resonance tracking scheme also uses a technology disclosed herein to measure the phase angle '$\Phi$' between the input force waveform and the waveforms of the displacement '$\Phi_d$', the velocity '$\Phi_v$', and/or the acceleration '$\Phi_a$' of sonic head 12. The sonic drill apparatus 226 may be an eccentric driven continuous resonant system, but other means of causing vibration of the drill bit are envisioned. Sonic drill apparatus 226 has three distinct different frequencies that correspond to the maximum displacement '$\omega_M$', displayed in Equation 14, maximum velocity '$\omega_v$', and maximum acceleration '$\omega_A$', respectively. In this embodiment, the velocity and acceleration amplitude peaks are located at higher frequencies than the displacement peak. For example, '$\omega_A$' and '$\omega_v$' are located at higher frequencies than '$\omega_M$' because the acceleration 'a(x,t)' is related to the displacement 'u(x,t)' by the negative square of the forcing frequency '$\omega_f$', as shown in Equation 28, and the velocity 'v(x,t)' is related to the displacement by the forcing frequency '$\omega_f$', presented in Equation 29.

$$a(x,t)=-\omega_f^2 \cdot u(x,t) \quad \text{Equation 28}$$

$$v(x,t)=\omega_f \cdot u(x,t) \quad \text{Equation 29}$$

Figure 8:
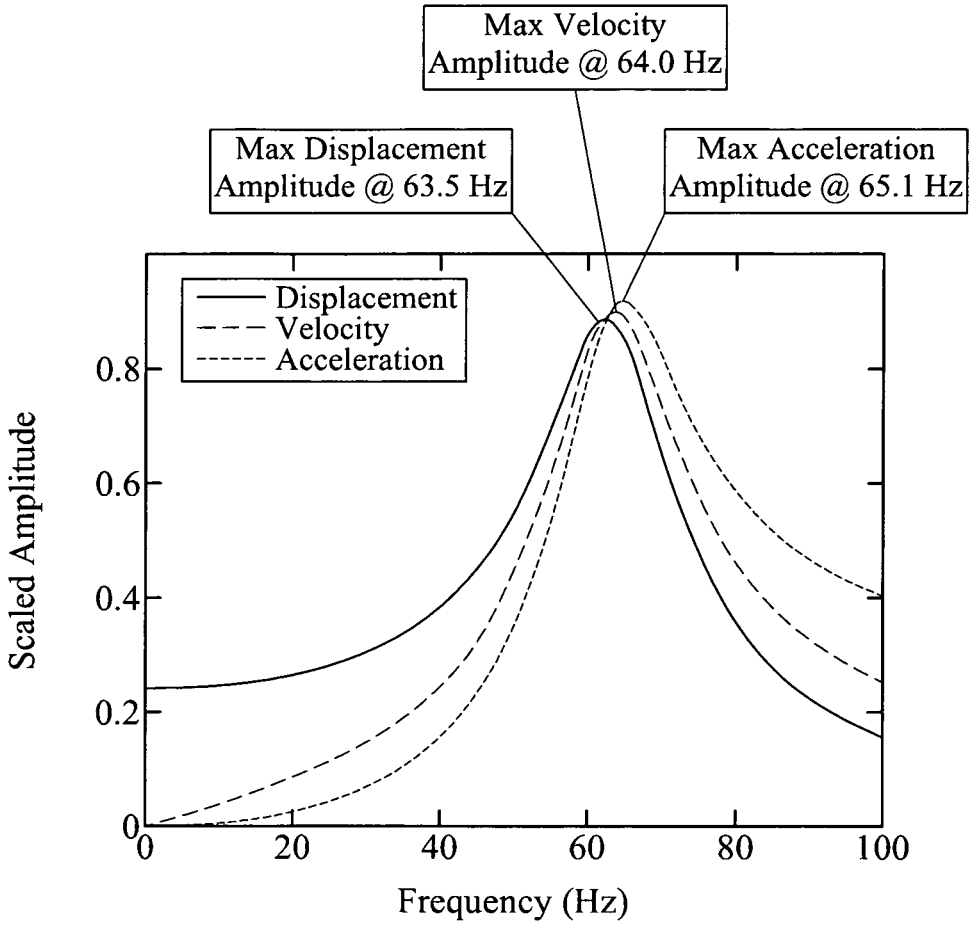
FIG. 8 is a chart that shows the frequencies at which the maximum displacement, the maximum velocity, and the maximum acceleration amplitudes occur in accordance with an embodiment of the invention.

Referring to FIG. 8, the frequencies at which the maximum displacement, the maximum velocity, and the maximum acceleration amplitudes occur are shown. The maximum displacement '$\omega_M$', maximum velocity '$\omega_v$', and maximum acceleration '$\omega_A$' angular frequencies are located at different frequencies because velocity and acceleration are related to displacement by the operating frequency and operating frequency squared, respectively. The maximum velocity angular frequency '$\omega_v$' is the most important parameter because the power is maximized at this frequency.

Figure 9:
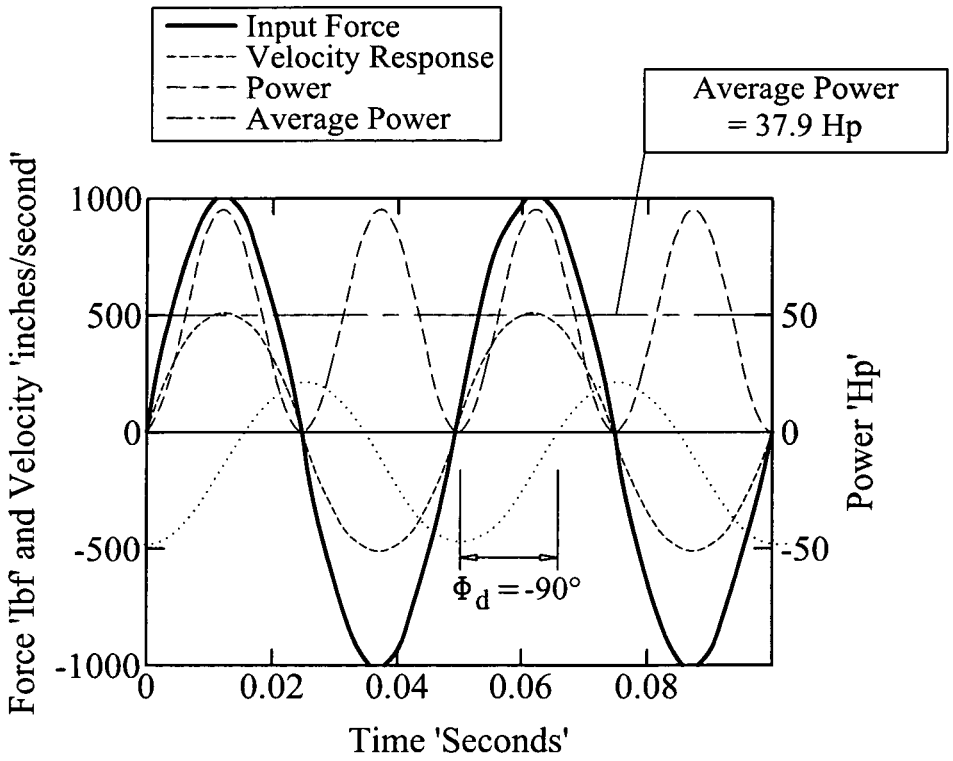
FIG. 9 is a chart that shows the penetration response of an example sonic drill with a power factor of one.
Figure 10:
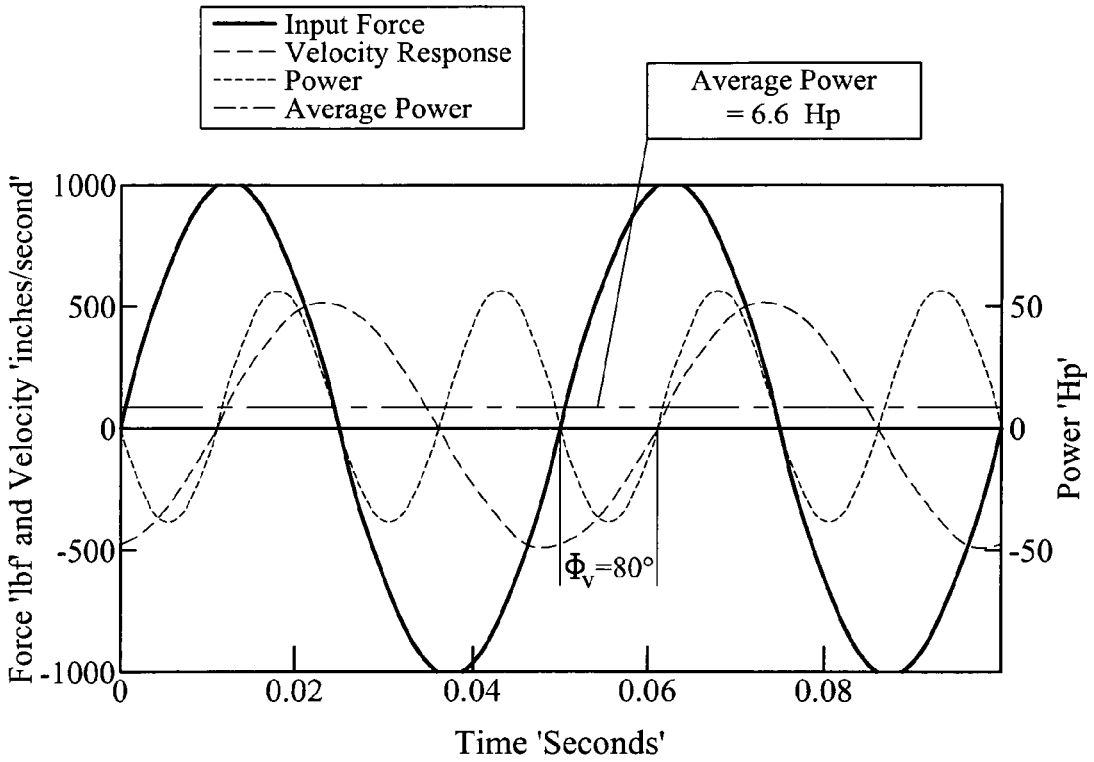
FIG. 10 is a chart that shows the penetration response of an example sonic drill with a lagging power factor of 0.174.

Referring to FIG. 9, the penetration response of sonic drill apparatus 226 has an analog similar to an electrical circuit with a band pass filter applied. The efficiency of the oscillatory penetration apparatus is maximized by operating the oscillatory penetration apparatus at a phase angle '$\Phi_d$' between the oscillatory input force waveform and the oscillator displacement waveform of about −90 degrees. FIG. 10 describes how an example sonic drill apparatus 226 with a power factor of one behaves. The total power is always positive and, thus, sonic drill apparatus 226 is always using the power to do real work. The average power is thus equivalent to the input power from source 210.

Referring to FIG. 10, the behavior of an example sonic drill apparatus 226 with a power factor of 0.174 is illustrated. When an example sonic drill has a lagging power factor of 0.174, the actual power has a large amount of negative power, thus sending power back to the source (e.g., a diesel engine). This takes power away from sonic drill apparatus 226 to do actual work. The average power thus used by the system to do work has now dropped to 6.6 Hp as opposed to a power factor 1 with 37.9 Hp.

Figure 11:
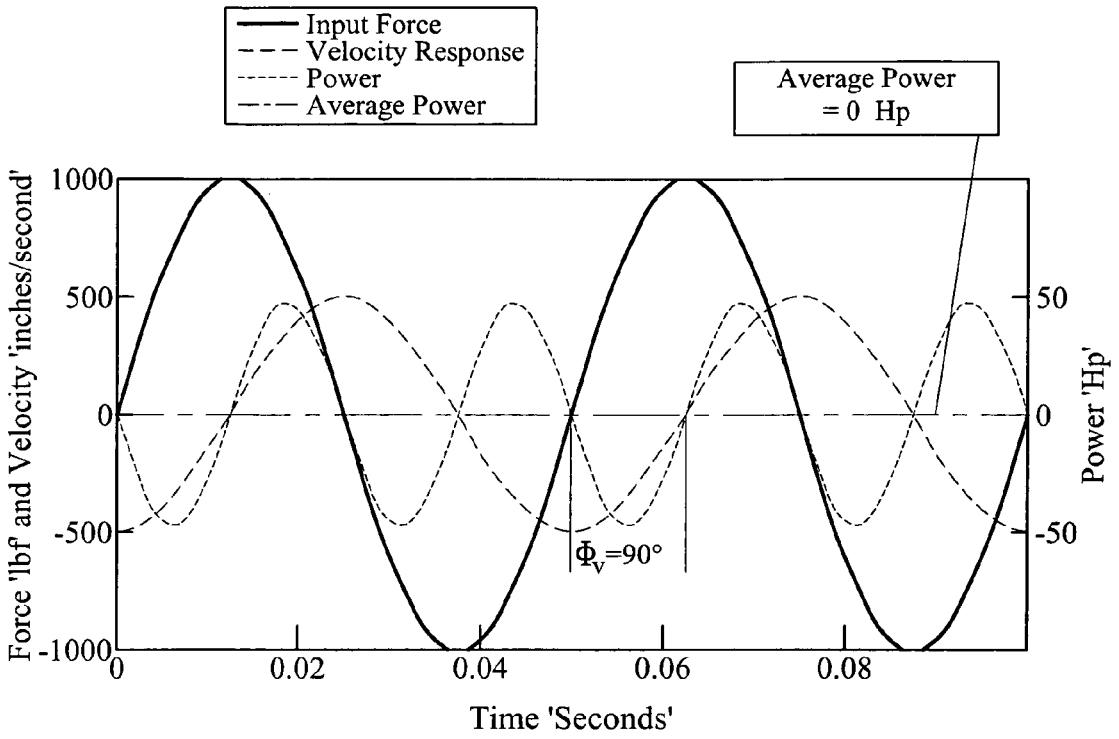
FIG. 11 is a chart that shows the penetration response of an example sonic drill with a lagging power factor of zero.

Referring to FIG. 11, the behavior of an example sonic drill apparatus 226 with a lagging power factor of 0 is illustrated. Sonic drill apparatus 226 stores power obtained from the source (e.g., a diesel engine) and then rejects it back to the source, and is thus doing no actual work and produces zero average power.

Figure 12:
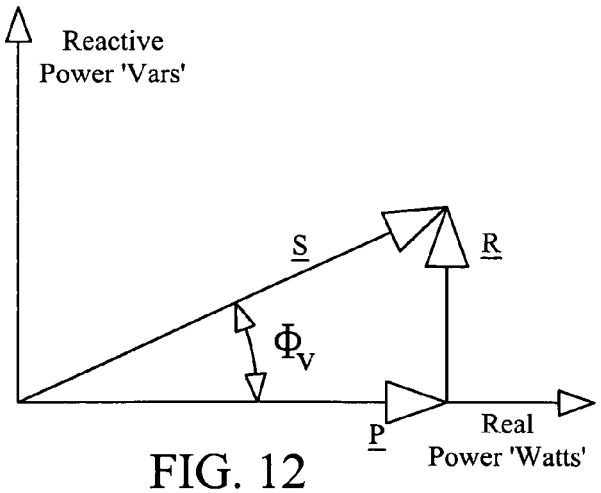
FIG. 12 is a chart that shows the relationship between real power '$\underline{P}$', reactive power '$\underline{R}$', and apparent power 'S'.

Referring to FIG. 12, a chart that shows the relationship between real power 'P', reactive power 'R', and apparent power 'S' is presented. As the angle '$\Phi_v$' increases, more of the total power from the source (diesel engine) is rejected back to the source, which causes the power 'P' that is available to do real work to decrease.

In an embodiment of the invention, the most important resonant frequency of a sonic drill apparatus 226 is '$\omega_v$'. The maximum velocity angular frequency '$\omega_v$' is the frequency where the maximum power is transferred to drill string 14. The maximum power is located at '$\omega_v$', because work 'W' is defined by the force 'F' multiplied by distance moved 'du', as indicated in Equation 30.

$$W=F*du \qquad \text{Equation 30}$$

However, the instantaneous power displayed in Equation 31, is defined as the force 'F' multiplied by the velocity 'v'. The maximum work is located at '$\omega_M$' while the maximum power values are located at '$\omega_v$'.

$$P=F*v \qquad \text{Equation 31}$$

In one embodiment, the resonant tracking scheme in accordance with the invention uses these phase angles to track the frequency at which the maximum velocity amplitude '$\omega_v$' is found, by taking the derivative of Equation 26. Finding '$\omega_v$' for the sonic drill string is very advantageous because this is the point at which the most energy is transmitted to drill bit 19 for drilling.

Drilling effectiveness may be determined using any of a plurality of measurements, such as rate of penetration, power utilization, power efficiency, power factor, sound pressure, sound intensity, phase difference between the oscillatory input force waveform and a value that characterizes the oscillatory displacement waveform. In one embodiment, drilling effectiveness is based on the amount of penetration vs. any other measurement. The higher the rate of penetration relative to any such measurement is, the better the drilling effectiveness. In one embodiment, the sound pressure is the absolute local pressure deviation from ambient conditions, whereas the sound intensity is the sound power per unit area. The sound intensity is typically measured by means of a decibel meter. The sound pressure is typically measured with a microphone to get the raw sound signal, whereas the decibel meter converts the raw signal into a rms value and subsequently converts it to the decibel scale.

Because sonic drill apparatus 226 has two distinct types of damping, one along the length of drill string 14 and the other at drill bit 19, these two types of damping can be solved independently and then their solutions can be superimposed on each other. In one embodiment of the invention, the damping along the length of drill string 14 is measured before and after each new section is added. In this embodiment, after the damping profile is found along the drill string length, drilling begins. While drilling, the damping on the end of the drill string, e.g., at drill bit 19, can be found by the use of the superposition method. The superposition method divides the total solution into two independent solutions, which are then summed to equal the total solution. For example, a sonic drill apparatus may be divided into two subsystems as follows: (1) the axial drill string with damping along the drill string and (2) the axial drill string with damping only at the drill bit. The sum of these solutions adds up to the total solution, thus the damping at the drill bit can be independently determined. Thus, by measuring the amount of damping at drill bit 19 during drilling, the type of the material being drilled may be determined and recorded.

In one embodiment of the invention, one or more transducers sense physical quantities associated with the penetration device, e.g., sonic drill apparatus 226. The transducers feed measurement data into control system 200 that uses the data and modifies the apparatus driving parameters, which in turn drive the apparatus at the new driving conditions that match the driving parameters. In this embodiment, control system 200 is intended for use with penetrating or coring systems.

Examples of oscillatory penetrating systems include any type of drill, pile driver, ultrasonic/sonic driller/corer (USDC) or sonic drill. One embodiment includes the control of the oscillating force along with the push-pull (constant) force applied to the oscillating member, typically the drill pipe, drill stem, or drill string 14. The drill stem is a generic term that includes all of the drill pipe, the drill bit, and any other assemblies in the hole. A drill string is typically made up of many drill pipes. An ultrasonic/sonic driller/corer is typically referred to as a horn and a free mass. The horn and free mass are used in small applications in the place of the drill string that is used in larger sonic drilling applications. The oscillating force is typically governed by the frequency and magnitude of the input force, assuming a sinusoidal forcing function. However, many different kinds of forcing functions may be applied. In some embodiments, this invention may be used to control any periodic forcing function. The forcing function typically dictates only the magnitude of the amplitude response of the apparatus, whereas boundary conditions, such as the constant input force, significantly affect the type of response the apparatus has to the input oscillatory force.

Figure 13:
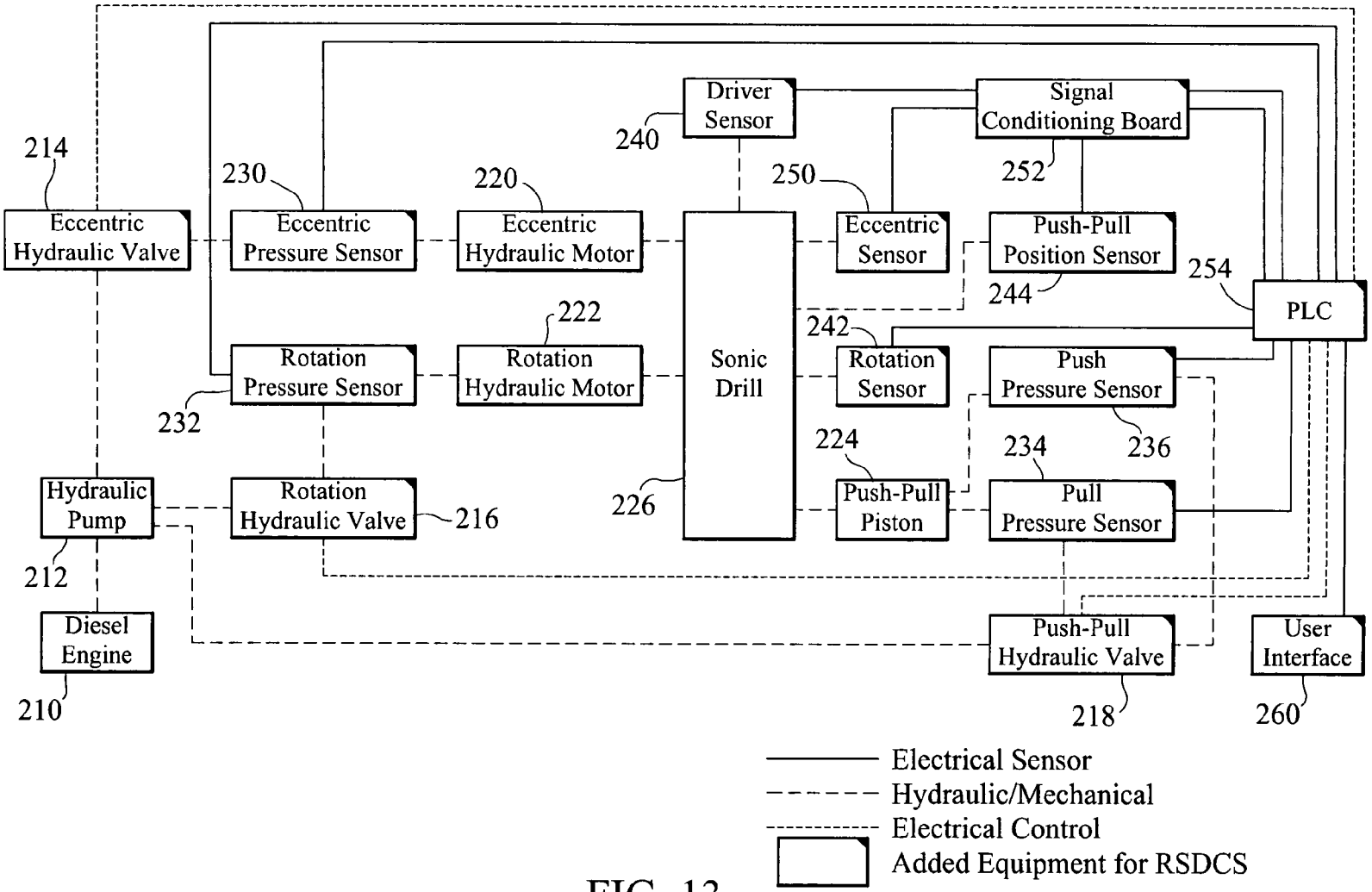
FIG. 13 is a schematic diagram of a resonant sonic drill control system in accordance with an embodiment of the invention.

Referring to FIG. 13, an embodiment of a resonant sonic drill control system (RSDCS) 200 is presented. In this embodiment, resonant sonic drill control system 200 comprises mechanical system components, sensors and electrical to mechanical control devices. The mechanical system components include diesel engine 21, hydraulic pump 212, eccentric hydraulic valve 214, rotation hydraulic valve 216, push-pull hydraulic valve 218, eccentric hydraulic motor 220, rotation hydraulic motor 222, hydraulic piston or push-pull piston 224 and sonic drill 226. This is a typical arrangement for a sonic drill control system; however, some sonic drill control systems also comprise other mechanical features, such as a pneumatic spring, that would also have to be controlled. For simplicity, these other non-standard features are omitted from the example system shown in FIG. 13.

In the embodiment illustrated in FIG. 13, the sensors include eccentric pressure sensor 230, eccentric pressure sensor 232, pull pressure sensor 234, push pressure sensor 236, drive sensor or driver sensor 240, rotary sensor or rotation sensor 242, push-pull position sensor 244 and eccentric sensor. Some sensors may require a separate signal conditioning board 252 that converts raw signals into usable analog signals that programmable logic controller PLC 254 can utilize. The operator interacts with resonant sonic drill control system 200 via user interface 260. Electrical to mechanical control is provided by the hydraulic valves that control the speed of the eccentrics, the rotation speed of drill string 14, and the amount of pull or push force exerted on drill string 14.

In the embodiment illustrated in FIG. 13, a programmable logic controller (PLC) 254 receives direct inputs or conditioned signals from the sensors and utilizes the data through algorithms to adjust the control parameters. In FIG. 13, the mechanical system components connected by long dashed lines, electrical control systems connected by dotted or short dashed lines, and electrical sensors connected with solid lines. PLC 254 is interfaced with the operator by the used of a user interface or human machine interface (HMI) which is preferably displayed on a touch screen.

Figure 14:
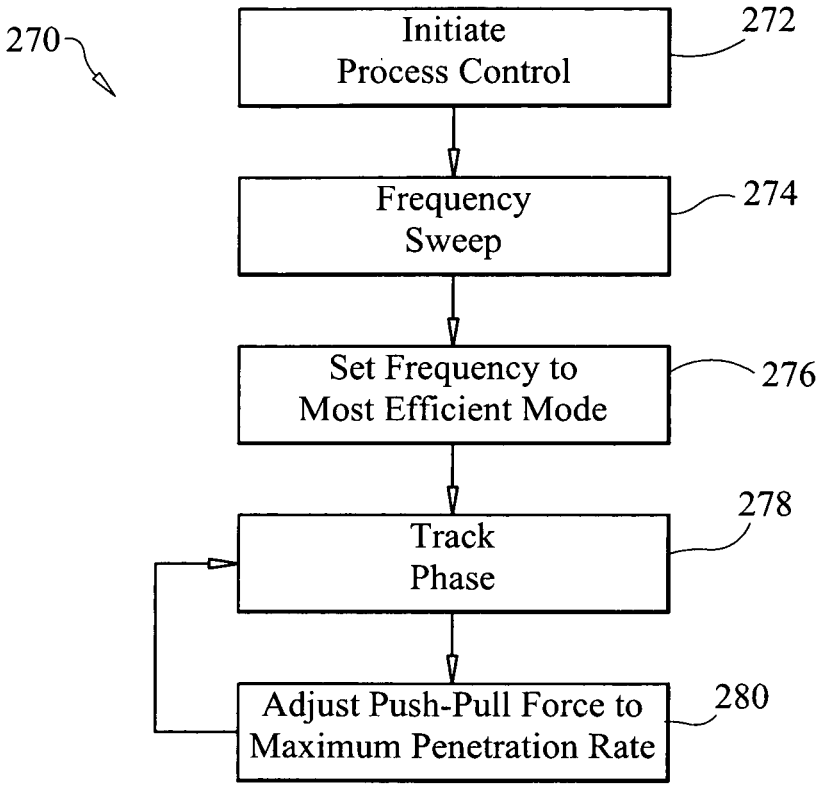
FIG. 14 is a high level schematic process flow diagram for operation of a resonant sonic drill control method in accordance with an embodiment of the invention.

Referring to FIG. 14, a high level schematic process flow diagram for an embodiment of resonant sonic drill control process 270 is presented. This is an example of one control methodology that may be utilized. However, other methods may also be used, as disclosed herein.

In the embodiment illustrated in FIG. 14, after resonant sonic drill control process 270 is initiated in initiate control step 272, a frequency sweep over the operating range of sonic drill apparatus 236 is performed in sweep frequencies step 274. A frequency sweep is performed by changing the frequency of the oscillating input force (e.g., speed of rotation of counter rotating eccentrics 60) fast enough to not excite sonic drill apparatus 236 to harmful amplitudes, but also slow enough to allow time for the vibrations of sonic drill apparatus 236 to build to adequate amplitudes so that usable data can be recorded. An appropriate speed for the frequency sweep is determined by the amount of damping of the apparatus and the time constant of the apparatus.

In this embodiment, during the frequency sweep, displacement, velocity, and/or acceleration amplitude and phase of the sonic driver are measured by driver sensor 240. Then, each measured velocity or each measured acceleration is converted into a relative displacement amplitude by dividing each measurement by the angular frequency of excitation or the angular frequency of excitation squared, respectively. This step produces a result similar to that illustrated in FIG. 15. FIG. 15 presents the results of a frequency sweep of a sonic drill that is drilling through hard rock and another frequency sweep with a sonic drill that is drilling into a void.

In one embodiment, the most efficient mode for drilling is the mode that has highest penetration rate with the lowest input power. The variables that affect the mode efficiency include type of strata being drilled through, input force magnitude, input force frequency, amount of damping along the drill string, rate of rotation of the drill bit and drill string, flow rate of the flushing media, and push or pull force magnitude and direction. In an illustrative embodiment, the most efficient mode for drilling is defined as the highest resonant frequency at which a phase angle between the oscillatory input force waveform and the oscillator displacement waveform of about −90 degrees is achievable (the oscillatory displacement waveform is about 90 degrees behind the oscillatory input force waveform).

From the resultant data, the most efficient operating mode is determined by a computer, e.g., PLC 254, in set frequency step 276. PLC 254 then controls sonic drill apparatus 236 to operate in the most efficient operating mode by tracking the phase difference between the input force waveform and the resultant response waveform at the input force location in track phase step 278 and adjusting the push-pull force magnitude and/or direction to achieve the maximum penetration rate in adjust push-pull force step 280.

A person having ordinary skill in the art would understand that a computing device other than PLC 254 could be programmed to cause control system 200 to perform the steps disclosed herein. For example, the computing device could be a personal computer, a processor, a microprocessor, a microcontroller, etc. Moreover, the computing device could be programmed to execute a computer program (software instructions) that are stored on a computer readable medium. Appropriate computer readable media include a read-only memory (ROM), an erasable programmable read-only memory (EPROM), an electrically-alterable read-only memory (EAROM), a flash memory and/or an optical disk. Other equipment, such as power and data buses, power supplies, and the like would also be apparent to one skilled in the art.

In this embodiment, once sonic drill apparatus 226 is operating in the most efficient operating mode, PLC 254 controls the amount of push-pull force in order to maximize the penetration rate. In so doing, the operating conditions of sonic drill apparatus 226 are continuously and automatically adjusted to cause sonic drill apparatus 226 to operate in the most efficient operating mode even though the most efficient operating mode may shift. Adjustment to achieve the most efficient mode may also be required when the material being drilled changes during drilling.

Figure 15A:
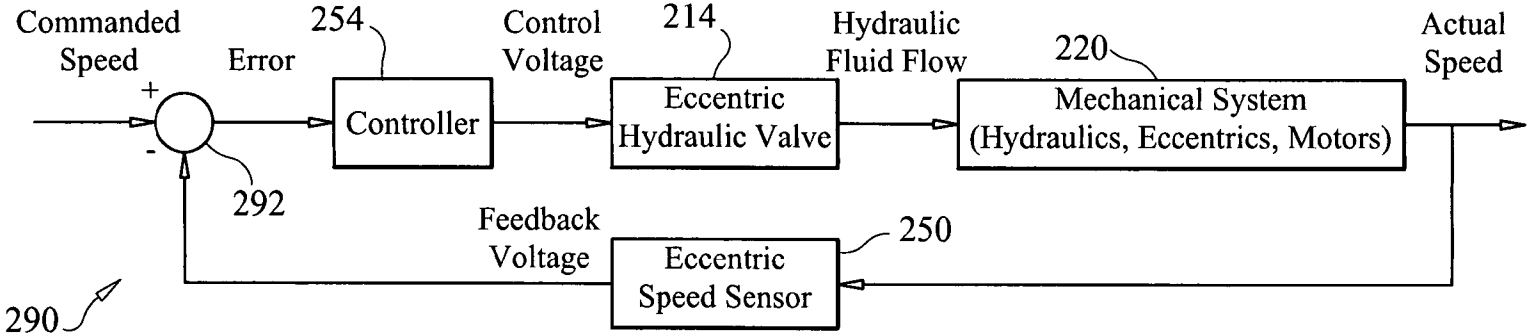
FIG. 15A is a schematic diagram of an eccentric speed feedback loop in accordance with an embodiment of the invention.
Figure 15B:
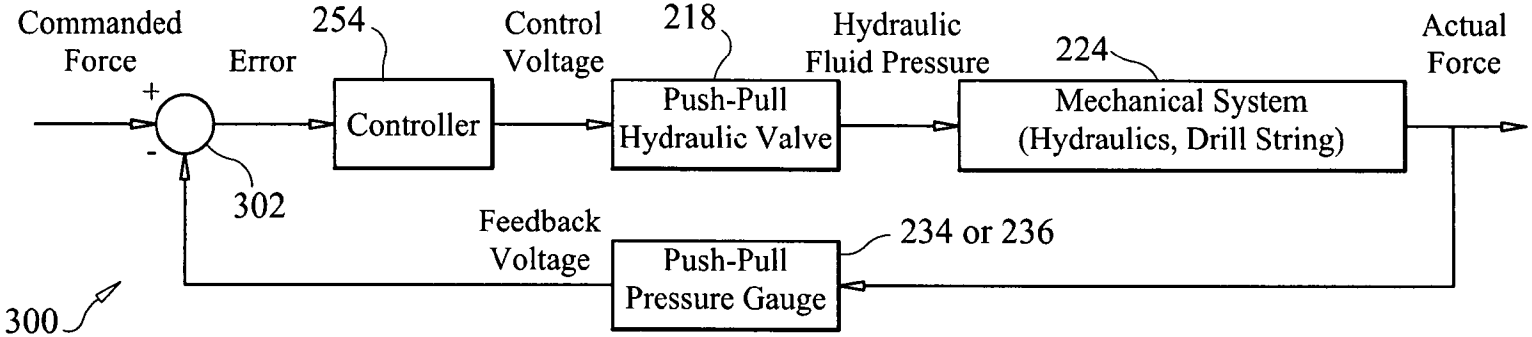
FIG. 15B is a schematic diagram of a push-pull force feedback loop in accordance with an embodiment of the invention.

In one embodiment, both the speed (frequency) of the eccentrics and the magnitude and direction of push-pull force imposed on drill string 14 are controlled by sonic drill control system 200. FIGS. 15A and 15B display an example feedback control loop for eccentric speed (frequency) and an example feedback control loop for push or pull force, respectively. The purpose of these feedback loops is to ensure that control system 200 is controlling sonic drill apparatus 226 to the desired system conditions. If apparatus operating conditions do not match the commanded (desired) conditions, this feedback control remedies the mismatch.

An example of a desired condition would be maximum drill string acceleration, velocity, displacement or jerk of the drill string or a specified acceleration, velocity, displacement or jerk amplitudes of the drill string. Maximum conditions are defined as the largest values achievable given the apparatus constraints, which include motor sizes, available input force, pipe sizes, boundary conditions, and pipe damping. An example of setting the sonic drill to operate at a specific amplitude condition would be to set the sonic drill to operate twenty percent under infinite life conditions of the apparatus; even though the apparatus can achieve higher amplitude values. Velocity is the derivative of the displacement with respect to time, acceleration is the derivative of the velocity with respect to time, and jerk is the derivative of the acceleration with respect to time. These conditions may be measured at the sonic drill head and are directly related to the motions of the drill string.

In further embodiment, control system 200 controls oscillatory penetration apparatus 226, said sonic penetration apparatus comprising components including frame 82, driver 12, that imposes an oscillatory input force waveform and a penetrating member that vibrates in accordance with an oscillatory response waveform. In this embodiment, control system 200 comprises: means for driving the oscillatory penetration apparatus; means for measuring a response of the oscillatory penetration apparatus; and means for controlling the oscillatory penetration apparatus; wherein said means for measuring a response measures at least a phase angle between the oscillatory input force waveform and the oscillatory response waveform.

In this embodiment, the oscillatory response waveform is characterized by measuring an acceleration, a velocity, a displacement or a jerk at a location on said oscillatory penetration apparatus that characterizes said response at an input force location. In one embodiment, the efficiency of the oscillatory penetration apparatus is maximized by operating the oscillatory penetration apparatus at a phase angle between the oscillatory input force waveform and the oscillatory acceleration waveform of about +90 degrees (the oscillatory acceleration waveform is 90 degrees ahead of the oscillatory input force waveform). In another embodiment, the efficiency of the oscillatory penetration apparatus is maximized by operating the oscillatory penetration apparatus at a phase angle between the oscillatory input force waveform and the oscillator velocity waveform of about zero degrees (the oscillatory velocity waveform is in phase with the oscillatory input force waveform). In another embodiment, the efficiency of the oscillatory penetration apparatus is maximized by operating the oscillatory penetration apparatus at a phase angle between the oscillatory input force waveform and the oscillator displacement waveform of about −90 degrees (the oscillatory displacement waveform is about 90 degrees behind the oscillatory input force waveform). In another embodiment, the efficiency of the oscillatory penetration apparatus is maximized by operating the apparatus at a phase angle between the oscillatory input force waveform and the oscillatory jerk waveform of about +180 degrees or −180 degrees (the oscillatory jerk waveform is about 180 degrees ahead or about 180 degrees behind the oscillatory input force waveform).

The applicant believes that there is no advantage of using one oscillatory response waveform over another other than ease of data collection and cost. The displacement waveform data are easily handled, but use of the acceleration waveform is advantageous because accelerometers are cost effective, easy to use and reliable. The listed response waveforms are related to each other by taking subsequent derivates of the displacement waveform, so they are easily converted, if the input and/or response frequency is known.

Referring to FIG. 15A, in eccentric speed feedback loop 290 a commanded (desired) speed voltage is compared to a feedback voltage at eccentric speed comparison point 292. If a speed error is detected, controller 254 sends a control voltage to eccentric hydraulic valve 214 which changes the rate or pressure at which hydraulic fluid is introduced to eccentric hydraulic motor 220. The actual speed of eccentric hydraulic motor 220 is sensed by eccentric speed sensor 250 which sends a feedback voltage to speed comparison point 292.

Referring to FIG. 15B, in push-pull force feedback loop 294 a commanded (desired) push-pull force voltage is compared to a feedback voltage at push-pull force comparison point 302. If a speed error is detected, controller 254 sends a control voltage to push-pull hydraulic valve 218 which changes the rate or pressure and direction at which hydraulic fluid is introduced to push-pull hydraulic piston 224. The actual force being exerted by push-pull hydraulic piston 224 is sensed by push pressure sensor 234 or pull pressure sensor 236 which sends a feedback voltage to push-pull force comparison point 302.

In one embodiment, sonic drill apparatus 226 is configured to rotate drill bit 19. Drill bit rotation is used for the following reasons: (1) to cause even wear on the drill bit, (2) to allow uniform drilling of virgin material, and (3) to aid in flushing out previously drilled material. Drill bit rotation may be implemented using any of three options: (1) rotation at the surface, in which the sonic head and pipe rotate or the sonic head is stationary and the drill string rotates, (2) rotation of the drill bit relative to the drill string, and (3) a combination of the above two options. Option (1) has been implemented by many sonic drill units, however, option (2) typically has been applied by down-the-hole hammers. Option (3) has not been applied to the applicant's knowledge, but would be particularly useful if the rate of rotation is much greater than can be accomplished above ground, because providing additional rotation at the drill bit would allow for optimal drilling by enabling the correct rotation rate for the drilling situation.

Figure 16A:
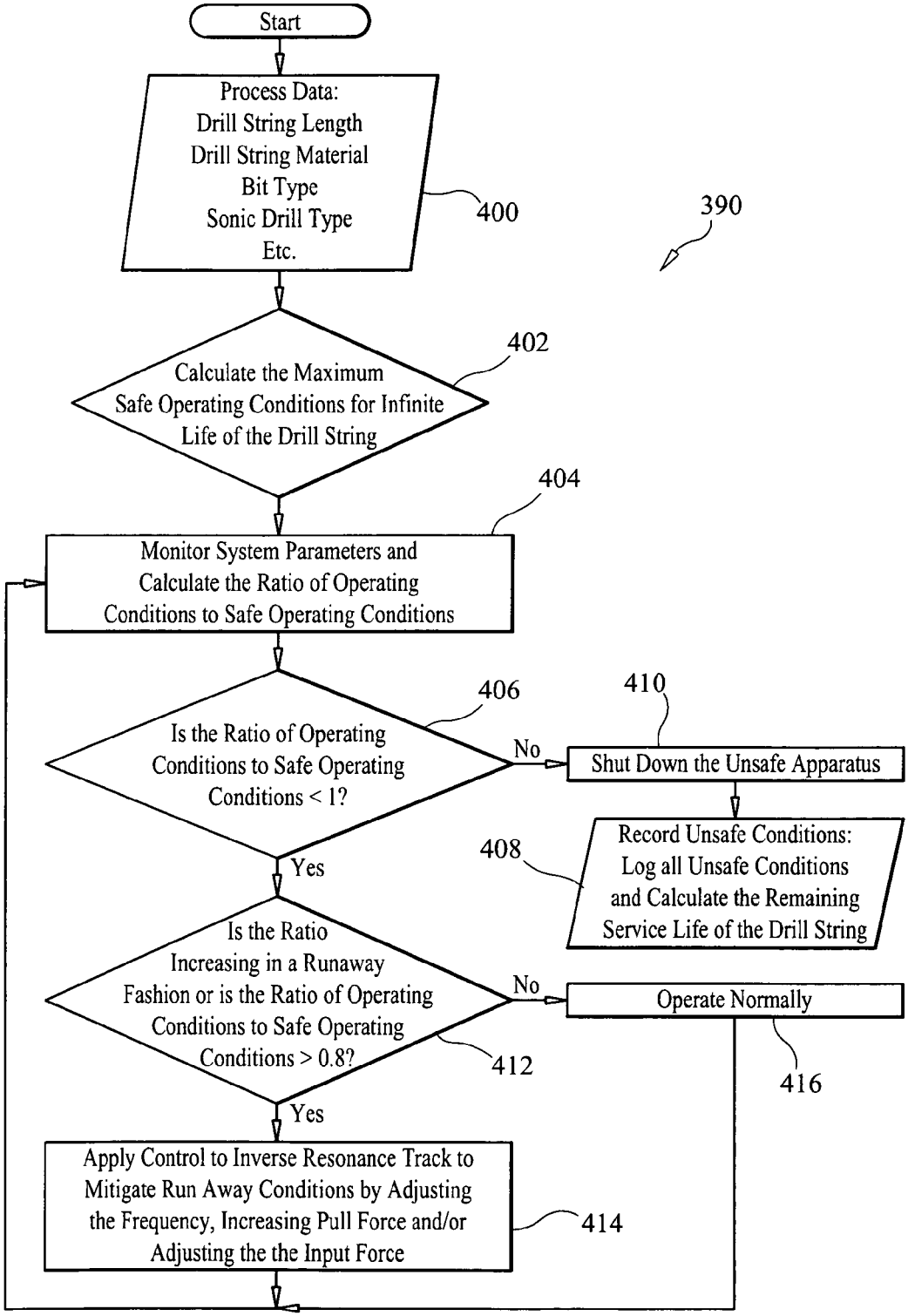
FIG. 16A is a schematic flow diagram of a safety control process for an embodiment of the invention.
Figure 16B:
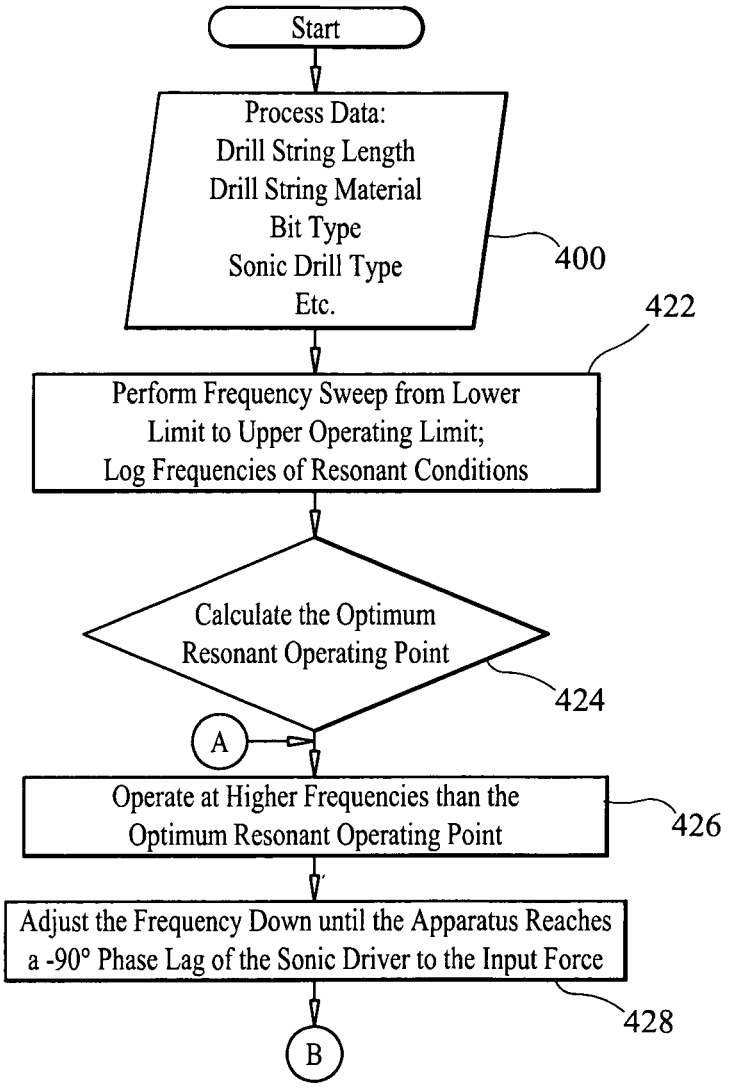
FIGS. 16B and 16C are schematic flow diagrams of a normal operations control process for an embodiment of the invention.

Referring to FIGS. 16A and 16B, schematic flow diagrams of control process 270 in accordance with another embodiment of the invention are presented. FIG. 16A presents the steps in an embodiment of a safety control process 390 that runs in the background in one embodiment of control process 270. In input data step 400, process data such as drill string length, drill string material, drill bit type, sonic drill type, etc. for sonic drill apparatus 226 are input to control system 200. In calculate maximum safe operating condition step 402, maximum safe operating conditions (e.g., maximum safe scaled displacement amplitude) for sonic drill apparatus 226 are calculated by control system 200. The maximum safe scaled displacement amplitude is determined by the size of the drill pipe, drill pipe material, and desired safety fatigue factor using standard machine design practices. Such standard machine design practices include those taught in machine design courses and which are used by those having ordinary skill in the art of mechanical engineering, for example, see those described in *Shigley's Mechanical Engineering Design*, Eighth Edition, McGraw Hill, which description is incorporated by reference as if fully set forth herein. Appropriate safety fatigue factors are determined by using the ultimate tensile strength of the pipe material, size of drill pipe, length of drill pipe in the drilled hole, etc.

Sonic drill operating conditions are monitored in monitor apparatus step 404. In this step, control system 200 measures the actual displacement amplitude of sonic drill apparatus 226. The actual amplitude is then scaled by creating a ratio of the actual amplitude relative to the predetermined safe displacement amplitude. Maintaining the ratio at a value less than one prevents damage to the apparatus.

In this embodiment, the resulting actual operation condition (e.g., scaled amplitude) is then compared to the safe operating condition (e.g., safe scaled operating amplitude) in compare amplitudes step 406. If the ratio of the of conditions is greater than one, the apparatus is shut down in shut down unsafe apparatus step 408 and all unsafe conditions are logged and the remaining service life of drill string 18 is calculated in record unsafe conditions step 410. If the ratio of conditions is less than one, then the ratio is tested again in retest conditions step 412. If the ratio is increasing in a runaway fashion or if the ratio is greater than a preselected value (e.g., 0.8), then control actions are take by control system 200 in apply control actions step 414. In this step, control system 200 may adjust the frequency of the input force, increase the push force, decrease the pull force and/or adjust the magnitude of the input force. If the ratio is not increasing in a runaway fashion or if the ratio is not greater than 0.8, then normal operation continues in operate normally step 416. After either step 414 or 416 are performed, control passes back to step 404.

A person having ordinary skill in the art would understand that the preselected value used in this example (0.8) is appropriate for the system disclosed herein, but is system dependent. An appropriate value should be determined for each system from inspection of the results of the frequency sweep. A generic value of 0.8 would work for most systems that are designed correctly.

In an alternative embodiment, if the resulting scaled amplitude is determined to be less than the scaled safe operating amplitude in compare amplitudes step 406, then the pipe is safe and will not fatigue and break and no change in the amount of push-pull force is needed. If control system 200 determines that the resulting scaled amplitude is excessive in compare amplitudes step 406, the amount of push-pull force is either increased or decreased and the excitation frequency is either increased or decreased to bring the system back to a safe operating condition in apply control actions step 414.

Figure 16C:
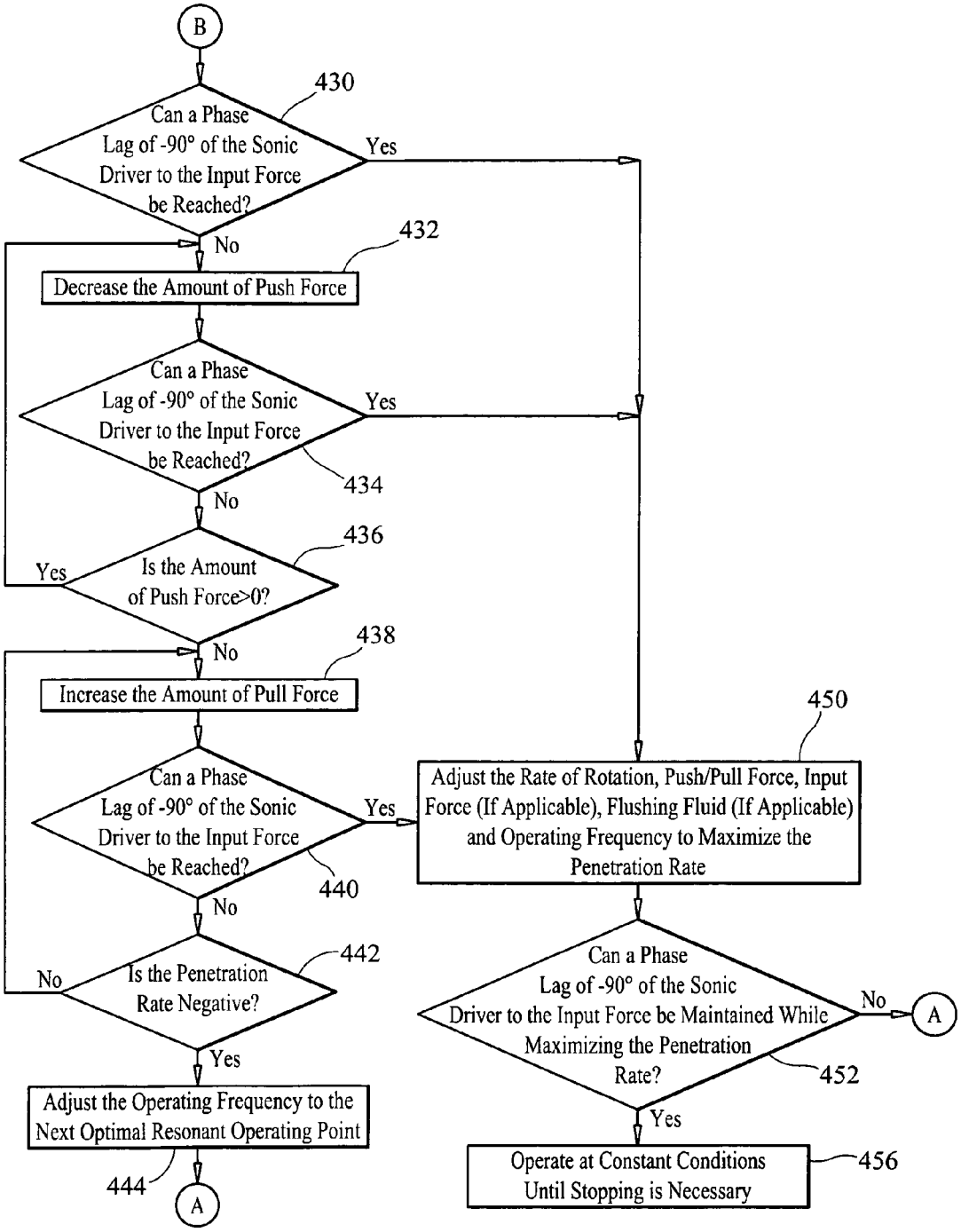
Figure 17:
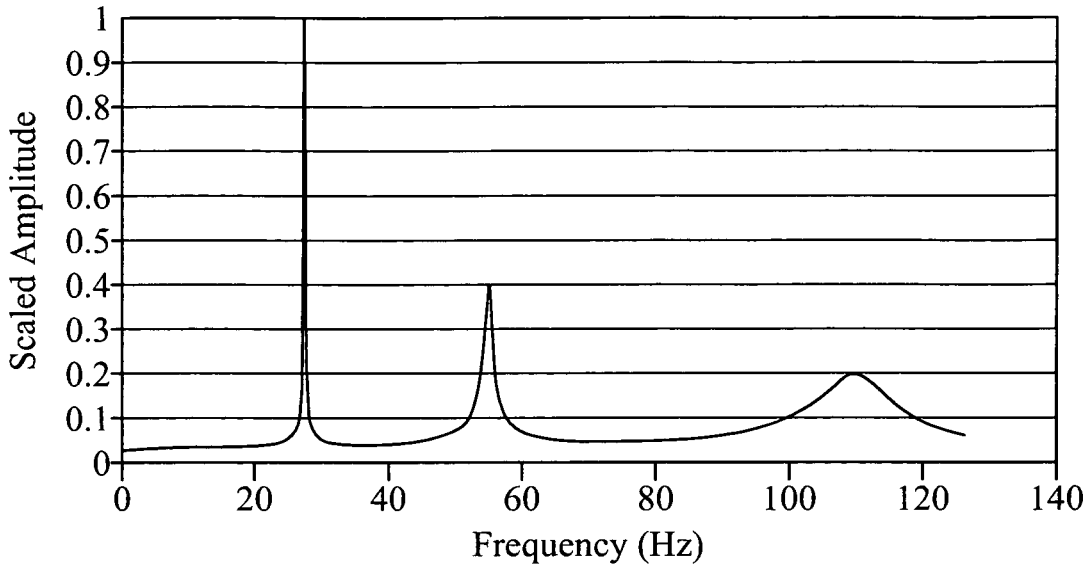
FIG. 17 is a chart that illustrates example sonic drill responses (scaled amplitudes) associated with a range of eccentric operating frequencies.
Figure 18:
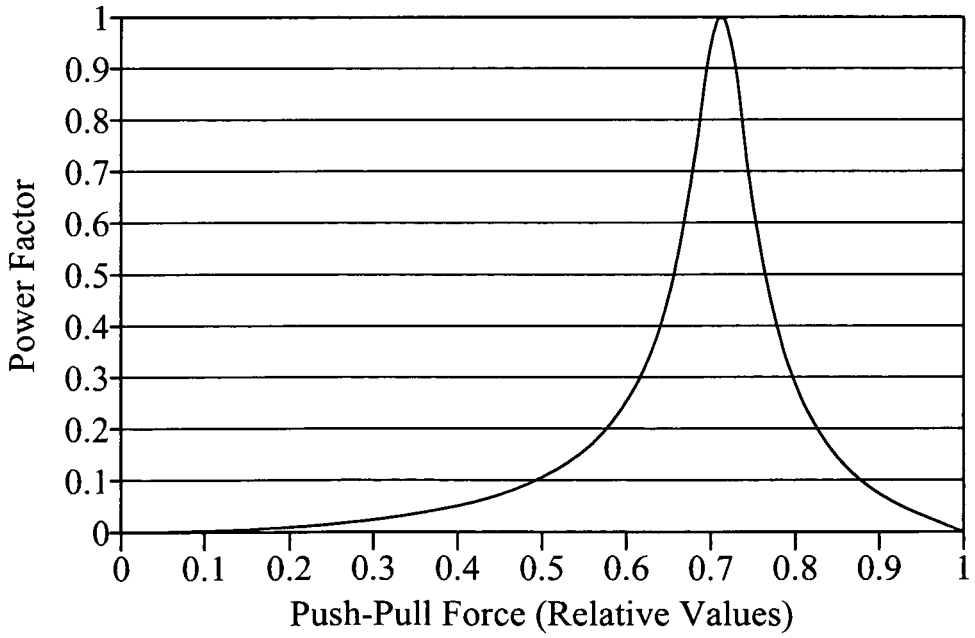
FIG. 18 is a chart that illustrates how adjustment of the push-pull force can be used to optimize the power factor.

FIGS. 16B and 16C present the steps in an embodiment of a normal control process 420 that runs when sonic drill apparatus is operating normally. In input data step 400, process data such as drill string length, drill string material, drill bit type, sonic drill type, etc. for sonic drill apparatus 226 are input to control system 200. In perform frequency sweep step 422, control system 200 performs a frequency sweep of the operating range from a lower operating limit to an upper operating limit and logs the frequencies that produce resonant conditions. An example of the response of sonic drill apparatus 226 during a frequency sweep is presented in FIG. 17.

Control system 200 then calculates the phase angle at each frequency over the operating range. The phase angle between the input force and the sonic head oscillation may be found by various methods. One method is by using the law of cosines, which uses a mathematical relation to determine the phase angle using the root mean square (rms) of the raw signals and the rms of the summed signal between the two raw signals. This may be done digitally or on an analog circuit board. A mechanical system using pressures, mechanisms, or magnetic systems may also be employed to measure the phase angle. Also the phase may be found by measuring the time delay between similar points on each of the oscillation waves. A commonly used point of reference is the zero crossing. For example, when the input force wave crosses zero, a timer is started and when the driver oscillation wave crosses zero, the timer is stopped. This measured time is then divided by the time for one oscillation of the input force wave to obtain a phase ratio. This phase ratio is the proportion in radians or degrees out of a full circle that the waves are out of phase. Then, by multiplying the phase ratio by two $\pi$ (pi) or by 360 degrees, the absolute phase angle may be determined in degrees. The frequency at which the phase angle is −90 degrees is determined and the desired frequency is determined is set. If a phase angle of −90 degrees is not achievable at some frequency in the operating ranges, then the push-pull force must be reduced and/or a positive pull force may be required. In one embodiment, a phase angle of −90 degrees is desirable because it is the operating point at which the power factor is equal to one and the greatest drilling efficiency is achieved.

Control system 200 then determines the optimal operating conditions for either maximum efficiency or maximum penetration rate conditions in determine optimum resonant operating point step 424. This is necessary because a sonic drill has many natural frequencies and control system 200 must determine which one is optimal for the given media being drilled. The optimum operating point is defined as the highest resonant frequency at which a phase angle offset of −90 degrees is achieved. This maximizes both the amount of power delivered and system efficiency.

Control system 200 then sets the input force frequency so as to cause sonic drill apparatus to operate at frequencies higher than the optimum resonant operating point in set input force frequency step 426. The input force frequency is adjusted downward with the goal of operating sonic drill at a phase lag of −90 degrees in adjust input force frequency step 428.

A test is performed to determine whether a phase lag of −90 degrees has been achieved in test phase difference step 430. If a phase lag of −90 degrees has not been achieved the magnitude of the push-pull force is decreased in decrease push-pull force step 432. The phase lag is then retested in retest phase difference step 434. If the phase difference is still not −90 degrees, control system 200 then determines whether the magnitude of the push-pull force is greater than zero in test push-pull force magnitude step 436. If the magnitude of the push-pull force is greater than zero, control returns to step 432. If the amount of force is not greater than zero, then the magnitude of the push-pull force is increased in increase push-pull force magnitude step 438.

After the magnitude of the push-pull force is increased in step 438, the phase difference is checked in check phase difference step 440. If a phase lag of −90 degrees has not been achieved, control system 200 determines whether the penetration rate is negative in determine penetration rate step 442. If the penetration rate is not negative, control returns to step 438. If the penetration rate is negative, control system 200 adjusts the operating frequency to the next most optimal frequency in readjust input force frequency step 444 and control returns to step 426.

If check phase difference step 440 determines that a phase lag of −90 degrees has been achieved, control system 200 adjusts the parameters of rate of rotation, push-pull force, input force (if applicable), flushing fluid (if applicable), and/or operating frequency to maximize the penetration rate in maximize penetration rate step 450. During the maximize penetration rate step 450, in one embodiment, the parameters are systematically adjusted in a circular fashion by incrementing each parameter until the penetration rate has reached a local maximum. The next parameter in the circular path is then adjusted in a similar manner and the process continues until all the parameters do not change for two iterations of the parameter circle. Control system 200 then rechecks the phase difference in recheck phase difference step 452 and determines whether a phase difference of −90 degrees can be maintained while the penetration rate is maximized. If a phase difference of −90 degrees cannot be achieved, control is passed to step 426. If a phase difference of −90 degrees can be achieved, no action is necessary and, in operate at constant conditions step 456, sonic drill apparatus 226 is operated at constant conditions until stopping is necessary. If a section of pipe must be added, the impedance of the apparatus changes dramatically and previous operating conditions will not yield a −90 degrees phase lag. At that point, control passes to step 400. However, as the drill string becomes longer, the effect becomes smaller.

During operation of sonic drill apparatus 226, control system 200 also steps through safety control process 390 in which it monitors the responses of drill string 14 and determines if sonic drill apparatus 226 is operating close to or approaching unsafe conditions. If so, control system 200 either shuts apparatus 226 down or rapidly adjusts the frequency away from the unsafe frequency.

A person having skill in the art would understand that unsafe conditions can develop during rapidly changing drilling conditions. One such change in drilling conditions is when a void is encountered while drilling. The void causes a rapid decoupling of drill bit 19 from the surrounding drilled media. When this occurs, there is not enough damping of apparatus 226 to limit the magnitude of drill rig oscillations and thus the drill string starts to "run away." A runaway condition on resonance allows the energy to grow in the apparatus until either the apparatus undergoes structural failure or a safe equilibrium between the input force and damping returns. Control system 200 guards against damage by unsafe conditions by constantly monitoring apparatus operating parameters, such as the phase angle and the amplitude of the displacement of the sonic drill head, but monitoring any value that is related to either of these two values is envisioned by the applicant. Because apparatus 226 operates in resonance, oscillations grow in a controlled fashion, thus allowing control system 200 to detect and to change the operating conditions, such as input force frequency, input force amplitude, push or pull force, rate of drill bit rotation, and flow rate of the flushing media.

Design of control system 200 recognizes that some of its measurement devices are used to sense the movement of parts of apparatus 226 and if sensors are mounted on moving parts, they will eventually fail. Thus, in some embodiments of the invention, an electric circuit that can detect when a signal is lost is needed. Also, in some embodiments, if communication is lost between human machine interface 260 and controller 254, then control system 200 is able to detect the condition and shut down apparatus 226 safely.

The steps described above are based on achieving a −90 degree phase offset, but they could also be used to achieve any other power factor value. Any degree phase offset may also be used, but the maximum data resolution for determining the phase angle occurs at a −90 degree offset.

Embodiments of this invention may be used at all frequencies from sonic (10 Hz-20,000 Hz) to ultrasonic (greater than 20 kHz). One embodiment includes control of both the inout (oscillating) force and the push-pull (constant) force, because push-pull force is needed for control and oscillatory force is required to remain true to drill type.

The application of too much push-pull (constant) force results in sonic drill apparatus 226 becoming too heavily damped and/or fused to the bottom of the hole and no drilling/coring takes place. Conversely, if too little constant force is applied, the result is that the drilling/coring bit does not maintain contact with the media being drilled and, thus, no penetration occurs. Because of these factors, in some embodiments of the invention a maximum penetration rate is achieved at a push-pull force application somewhere between maximum (where the bit is heavily damped or effectively fused to the media) and minimum (where the bit is not in contact with the media) push-pull force application.

As greater depths are achieved, the optimum push-pull force may have to become negative, or in other words, applied away from the media being drilled. The weight of drill string 14 also acts as a constant force and the longer drill string 14 is, the less the constant force has to be applied to sonic drill apparatus 226 above ground.

The nature of the material being drilled also affects the tip boundary condition, and, hence, the optimum amount of push-pull force to apply. Because rock behaves differently from sand with respect to the constant force, in some embodiments of the invention, control system 200 adjusts system parameters to produce optimal operating conditions. Because there is no intuitive method for controlling a background art sonic drill to achieve the conditions that maximize penetration rate and/or efficiency, some embodiments of the invention provide a smart control system 200 that uses measured parameters, control mechanisms and algorithms to automatically modify the oscillation frequency and amplitude along with the magnitude of push-pull force.

Background art sonic drills incorporate a pressure gauge for monitoring of the pressure of the hydraulic fluid used to drive the oscillating force mechanism (eccentrics). Monitoring only this pressure gives an indication only of when the maximum input power from source 210 is being used. In order to properly control the drilling process to obtain the desired operating characteristics, the ratio between the actual power used to do work and the total power supplied must be monitored. This ratio is typically referred to as the power factor. In some embodiments, the performance of sonic drill apparatus 226 is optimized by operation at a power factor at or close to one. If too much push-pull force is applied to apparatus 70, the available power to do work is greatly decreased. Also, when a sonic drill operator operates a background art sonic drill at the maximum hydraulic pressure and maximum push-pull force, the system actually is being operated at a point where the ratio of the actual power used to do work to the total input power is very low. Different methods may be used to determine the power factor. As disclosed herein, conventional electrical circuits, PLC's, personal computers, microcontrollers and/or mechanical systems may be used to determine the power factor, and that information may be used to control sonic drill apparatus 226 in accordance with some embodiments of the invention in order to achieve desired operating conditions.

Background art sonic drilling technology is limited to drilling to depths of no greater than 1,000 to 1,500 feet. The operators of background art sonic drills operate their equipment intuitively and, thus, the technology is subject to unnecessary depth limitations and inefficiencies. Use of a properly configured automatic control system 200 that employs the counterintuitive methods disclosed herein allows drilling depths and penetration rates to be drastically increased.

Figure 19:
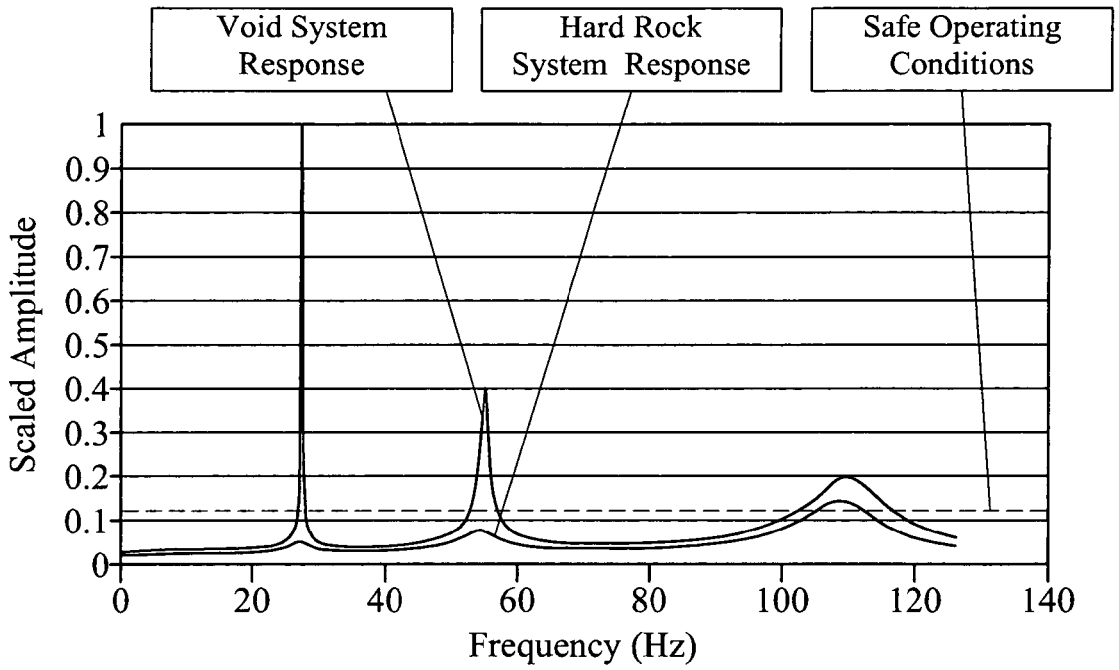
FIG. 19 is a chart that illustrates example sonic drill responses (scaled amplitudes) associated with a range of eccentric operating frequencies when drilling in hard rock and into a void.

Background art sonic drills have an inherent problem of becoming decoupled from the material being drilled. In these situations, background art sonic drills can generate an oscillation response amplitude that is damaging to the drill itself. When drilling through rock, for example, the drill is constantly being damped by the rock. If the drill then encounters a large void in the rock and the rock is no longer there to dampen the oscillation amplitude response, the response amplitudes of the drill can grow very rapidly and cause damage to the drill in less than a second, as illustrated in FIG. 19. This is much faster than an operator can react to such a situation. In one embodiment of the invention, however, control system 200 monitors the oscillation response amplitudes of sonic drill 226 by using measurement sensors, including, but not limited to accelerometers, velocity and displacement sensors, eddy current sensors, laser vibrometry, etc. and can modify the drill's operating parameters within milliseconds.

The system parameters that can be adjusted in a background art sonic drills are typically limited to the frequency of the input (oscillating) force, the torque of the rotation of drill string 14, the push-pull force being applied to drill string 14 and the amplitude of the input oscillation force. Sonic drills are resonant systems, and such systems can be taken off resonance much faster by changing the input oscillation force frequency to a higher or lower value than the push-pull force can be decreased. Moving a sonic drill off the resonant peak causes energy to be lost either by inertial or stored losses in drill string 14. Inertial losses are due to the moving mass of drill string 14 and the stored energy losses are the result of the restoring internal forces due to the elastic properties of drill string 14. This approach greatly damps out the runaway condition, thus preventing damage to the sonic drill. The push-pull force can also be increased in these conditions, but if a complete void is encountered, the increased force cannot be applied by the drill bit to anything, and thus this solution does not work. Along with controlling the input oscillatory forcing frequency and amplitude and the push-pull force magnitude, control systems in accordance with the invention may also control the torque being applied to produce rotation in the drill bit or drill string 14.

Working Example

Figure 20:
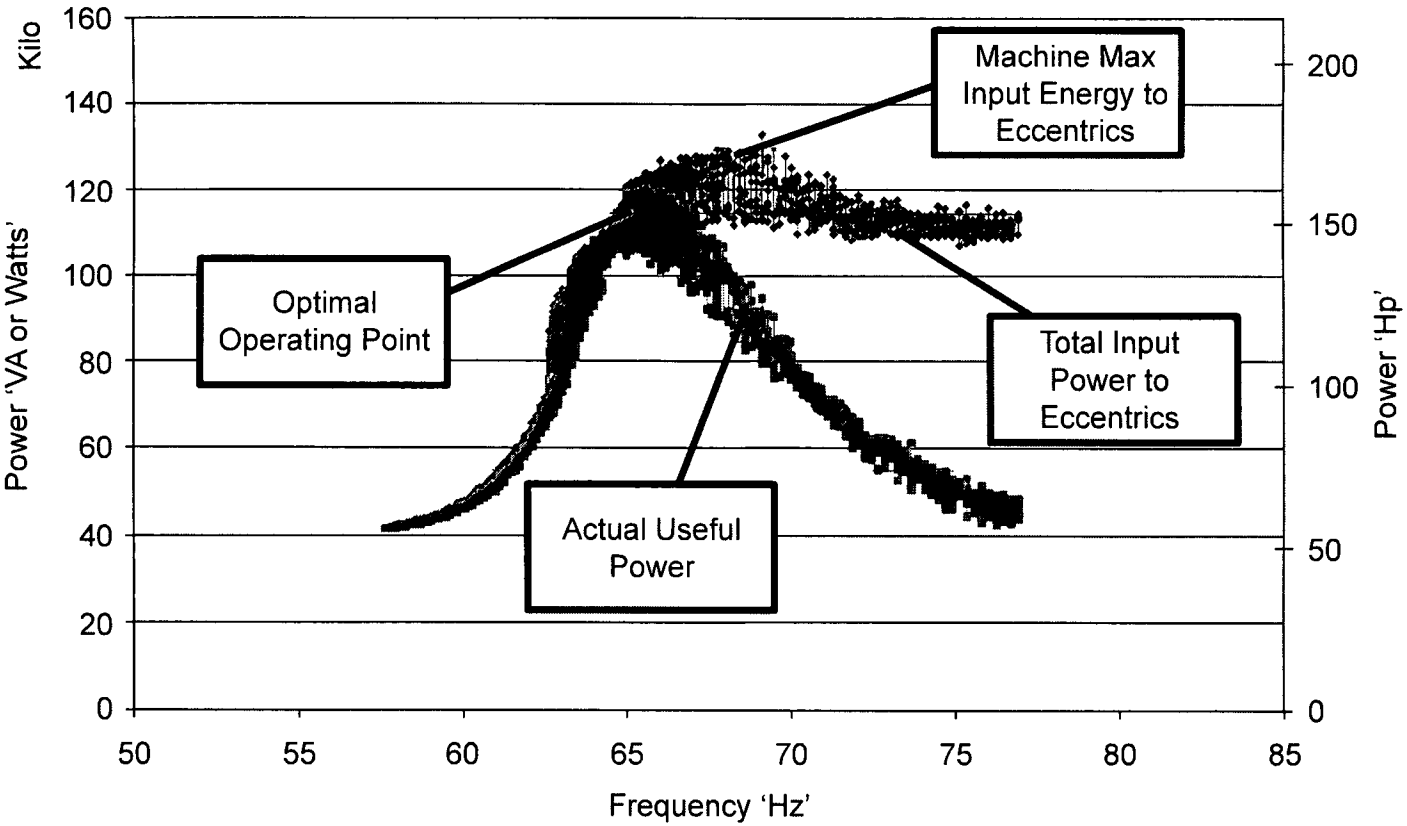
FIG. 20 is a chart that presents an analysis of data obtained by monitoring the operation of an example 750 Hp, eccentric driven, sonic drill.

Tests were conducted using an example 750 Hp sonic drill that was operated over an operating range that included sub-optimal and optimal operating conditions. FIG. 20 presents an analysis of data obtained by monitoring the operation of the example sonic drill. In FIG. 20, the actual useful power is plotted in watts and the total input power to the eccentrics is plotted in VA (volts times amperes referred to as Volt-Ampere). Actual useful power values were determined by integrating the input force and the velocity of the sonic drill head over time. Total input power values were determined by multiplying the root mean square of the input force with the root mean square of the velocity of the sonic drill head.

Figure 21:
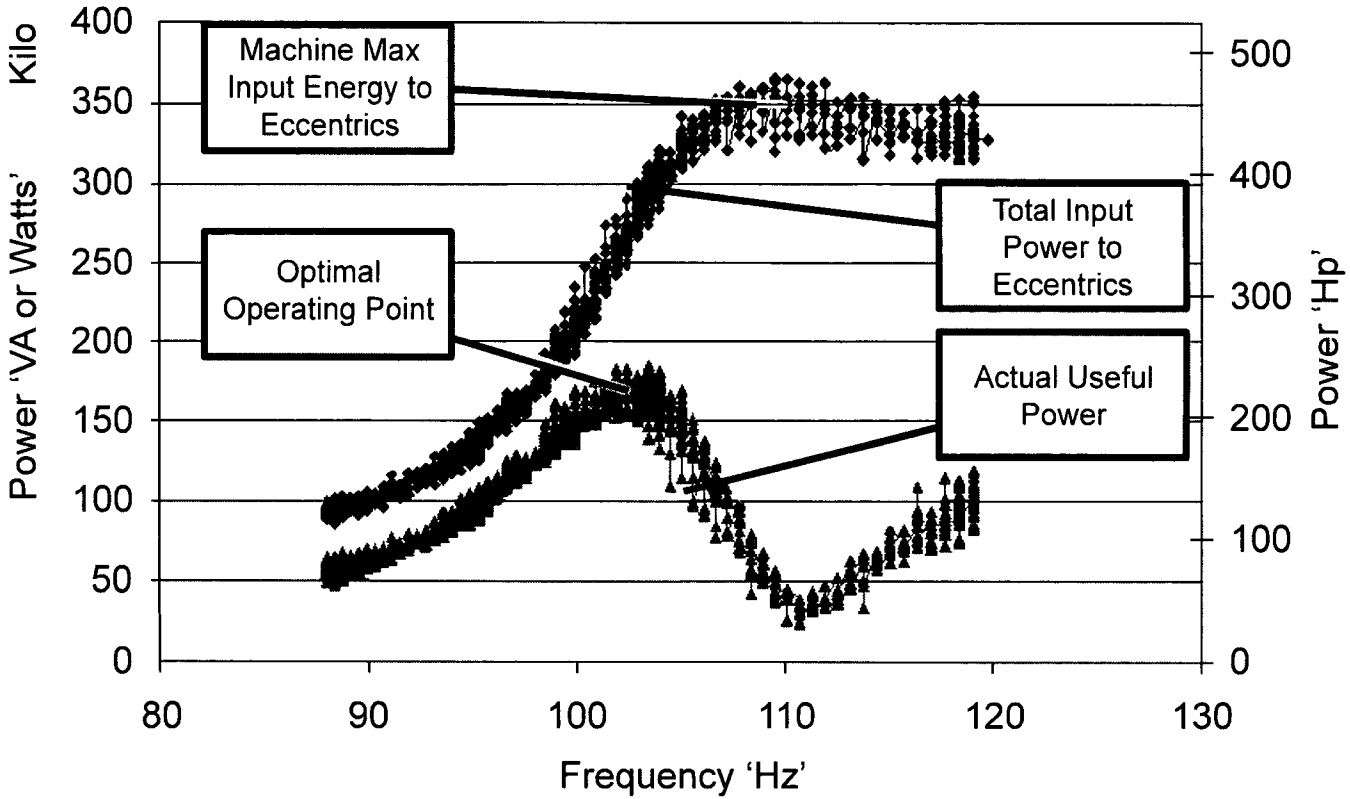
FIG. 21 is a chart that presents another analysis of data obtained by monitoring the example sonic drill.

This analysis indicates that a counter-intuitive method needs to be applied in selecting the push-pull force to apply in order to achieve maximum penetration rates. For example, the response of an oscillatory penetration or coring system can be drastically hindered by applying too much push-pull force, as displayed in FIG. 21.

Figure 22:
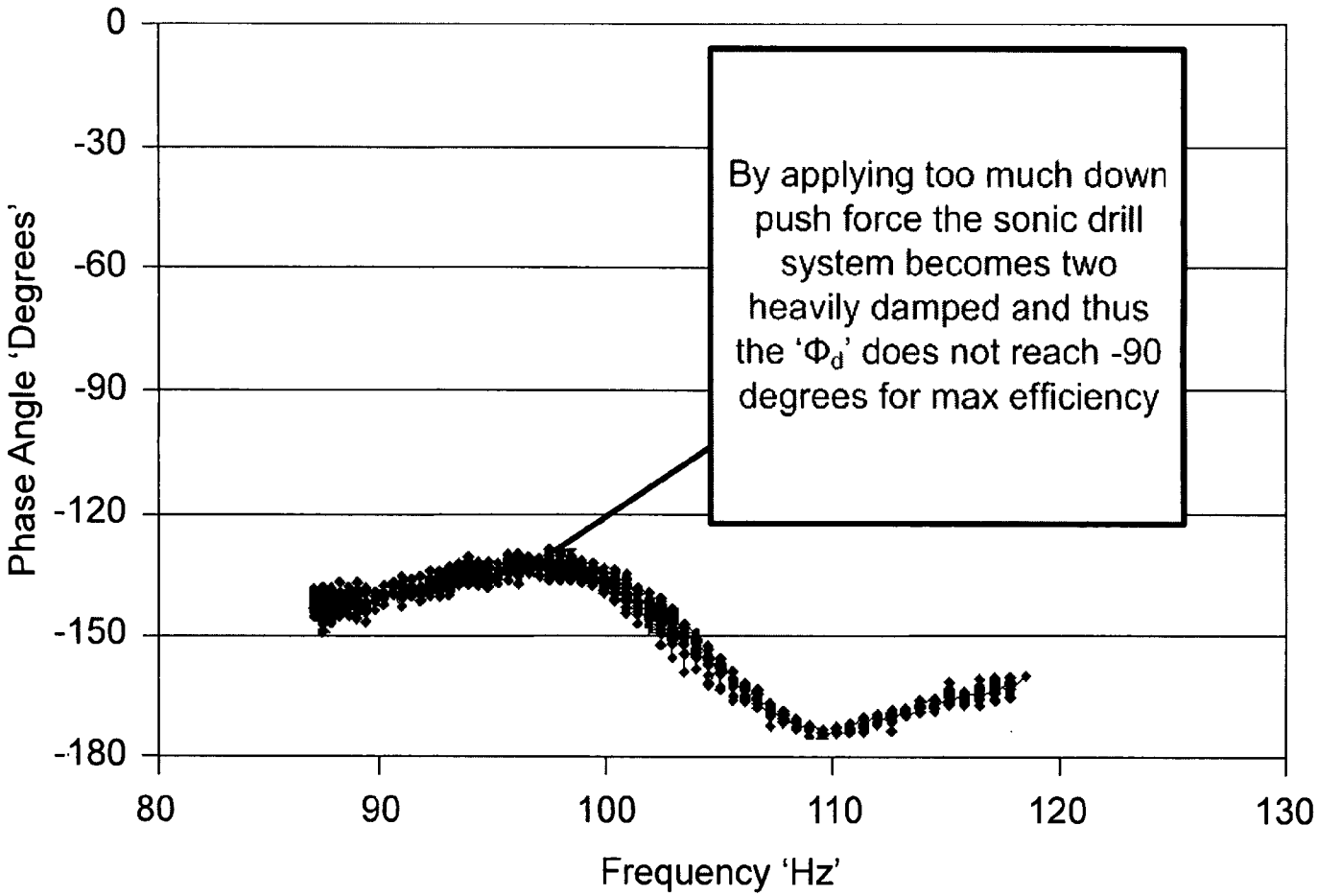
FIG. 22 is a chart that presents another analysis of data obtained by monitoring the example sonic drill.

Referring to FIG. 22, another analysis of data obtained by monitoring the example sonic drill is presented. In this chart, the phase angle between the input oscillatory force and the displacement amplitude at the location where the input oscillatory force is applied is presented. In this situation, too much push-pull force was being imposed, causing the sonic drill to be too heavily damped. The phase angle does not reach −90 degrees as required for maximum efficiency.

Figure 23:
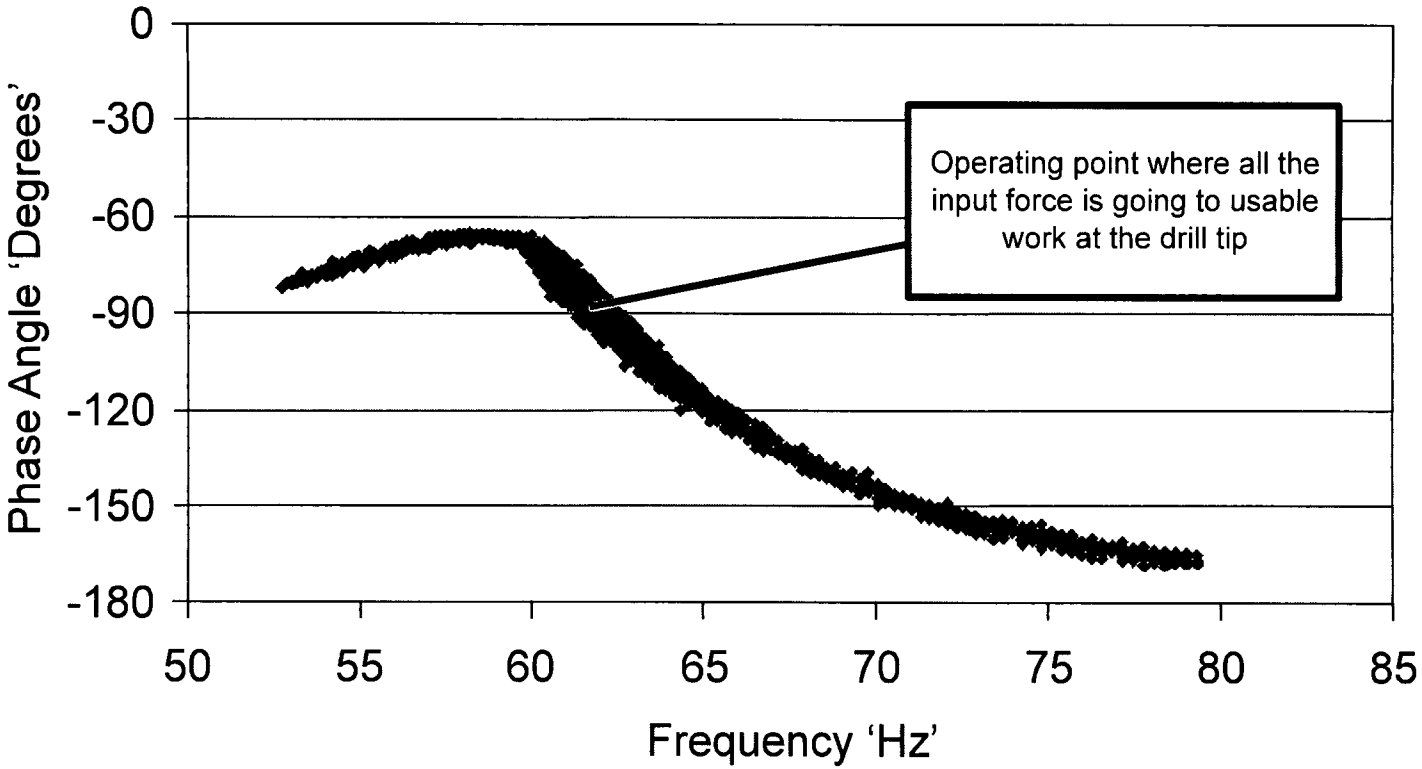
FIG. 23 is a chart that presents another analysis of data obtained by monitoring the example sonic drill.

Referring to FIG. 23, another analysis of data obtained by monitoring the example sonic drill is presented. In this chart, the phase angle between the input oscillatory force and the displacement amplitude at the location where the input oscillatory force is applied is presented. In this situation, a good phase plot over a frequency range is produced, which indicates that the push-pull force being imposed was not too large.

Many variations of the invention will occur to those skilled in the art. Some variations include means for detecting the type of material being drilled. Other variations call for incorporation of other means for imposing oscillating and push-pull forces on the drill string. All such variations are intended to be within the scope and spirit of the invention.

As a further example, the applicant specifically envisions using other types of responses to as inputs for the control of oscillatory penetration devices. The responses of the drill stem that are not in the primary (longitudinal) axis are two lateral translational movements and three rotations, because all three-dimensional objects have six degrees of freedom if unconstrained. By measuring the strain on the drill pipe at two locations, 90 degrees apart around the diameter, the bending modes can be determined relative to the primary axial translational response. The bending modes may be detected by means of two separate displacement sensors space along the primary direction and also located 90 degrees around the diameter of the drill pipe. These sensors may also be located on the sonic driver. As was noted above, displacement, velocity, acceleration, or jerk sensors in each of the lateral translational directions can sense lateral movements.

By fully characterizing the response of the apparatus in all six degrees of freedom, the total stress state of the sonic drill can be determined by coupling all three resonant modes of axial, torsional and bending stresses. The three independent resonant modes stress states may be combined to form the total stress state by using the method of superposition. This total stress state has greater accuracy than the stresses found by using just the axial stress state response. However, this approach is much more complicated and requires a great deal of computational power to find and predict the stress states along the entire drill stem. Thus, such added cost and time may not be practical for all applications. If desired, however, the governing partial differential equations for axial, bending, and torsional stress states may be found by modeling longitudinal waves (axial and torsional) and flexure waves (bending) in rods or any other drill stem geometry used.

The applicant envisions that by sensing responses in all six degrees of freedom, an indication of the full stress state of the drill stem at all times may be found and an accurate determination of the life of the apparatus and all unsafe operating conditions may be determined. Sensing the responses may be accomplished by means of strain sensors, displacement sensors, velocity sensors, acceleration sensors, non-contact sensors, rotary encoders, gyroscopes, multi-axis accelerometers, pendulums, angular sensors and other sensors described in this disclosure.

Although some embodiments are shown to include certain features, the applicant(s) specifically contemplate that any feature disclosed herein may be used together or in combination with any other feature on any embodiment of the invention. It is also contemplated that any feature may be specifically excluded from any embodiment of the invention.

What is claimed is:

1. A method for controlling an oscillatory penetration apparatus, said oscillatory penetration apparatus being subjected to an oscillatory input force waveform at an above-ground input force location and vibrating in accordance with an oscillatory response waveform, said method comprising:

driving the oscillatory penetration apparatus with a sonic head comprising rotating eccentrics that vibrate in accordance with the oscillatory input force waveform;

measuring a response of the oscillatory penetration apparatus; and controlling the oscillatory penetration apparatus;

wherein said measuring a response step comprises measuring at least a phase angle between the oscillatory input force waveform and the oscillatory response waveform at the above-ground input force location.

2. The method of claim 1 wherein controlling the oscillatory penetration apparatus comprises adjusting a push-pull force being imposed on the oscillatory penetration apparatus with a means for adjusting comprising a push mechanism and a pull mechanism to produce a desired penetration rate.

3. The method of claim 1 wherein the oscillatory response waveform is characterized by measuring an acceleration, a velocity, a displacement or a jerk at a measurement location on said oscillatory penetration apparatus that characterizes said response at said above ground input force location.

4. The method of claim 3 wherein the efficiency of the oscillatory penetration apparatus is maximized by operating the oscillatory penetration apparatus at a phase angle between the oscillatory input force waveform and the oscillatory acceleration waveform of about +90 degrees.

5. The method of claim 3 wherein the efficiency of the oscillatory penetration apparatus is maximized by operating the oscillatory penetration apparatus at a phase angle between the oscillatory input force waveform and the oscillator velocity waveform of about zero degrees.

6. The method of claim 3 wherein the efficiency of the oscillatory penetration apparatus is maximized by operating the oscillatory penetration apparatus at a phase angle between the oscillatory input force waveform and the oscillator displacement waveform of about −90 degrees.

7. The method of claim 3 wherein the efficiency of the oscillatory penetration apparatus is maximized by operating the apparatus at a phase angle between the oscillatory input force waveform and the oscillator jerk waveform of about +180 degrees or −180 degrees.

8. A system for controlling an oscillatory penetration apparatus, said oscillatory penetration apparatus being subjected to an oscillatory input force waveform at an above-ground input force location and vibrating in accordance with an oscillatory response waveform, said system comprising:

means for driving the oscillatory penetration apparatus;

means for measuring a response of the oscillatory penetration apparatus;

means for controlling the oscillatory penetration apparatus; and wherein said means for measuring a response measures at least a phase angle between the oscillatory input force waveform and the oscillatory response waveform at the above-ground input force location.

9. The system of claim 8 wherein the oscillatory response waveform is characterized by measuring an acceleration, a velocity, a displacement or a jerk at a measurement location on said oscillatory penetration apparatus that characterizes said response at the above-ground input force location.

10. The system of claim 9 wherein the efficiency of the oscillatory penetration apparatus is maximized by operating the oscillatory penetration apparatus at a phase angle between the oscillatory input force waveform and the oscillatory acceleration waveform of about +90 degrees.

11. The system of claim 9 wherein the efficiency of the oscillatory penetration apparatus is maximized by operating the oscillatory penetration apparatus at a phase angle between the oscillatory input force waveform and the oscillator velocity waveform of about zero degrees.

12. The system of claim 9 wherein the efficiency of the oscillatory penetration apparatus is maximized by operating the oscillatory penetration apparatus at a phase angle between the oscillatory input force waveform and the oscillator displacement waveform of about −90 degrees.

13. The system of claim 9 wherein the efficiency of the oscillatory penetration apparatus is maximized by operating the apparatus at a phase angle between the oscillatory input force waveform and the oscillator jerk waveform of about +180 degrees or −180 degrees.

14. The system of claim 8 wherein said means for controlling the oscillatory penetration apparatus comprises means for adjusting a push-pull force being imposed on the oscillatory penetration apparatus to produce a desired penetration rate, said means for adjusting comprising a push mechanism and a pull mechanism.

15. A sonic drill control system comprising:

a hydraulic pump that pressurizes a hydraulic fluid;

a diesel engine that drives said hydraulic pump;

a sonic drill comprising a drill string and a driver comprising an eccentric that produces an oscillatory input force waveform, said sonic drill apparatus being operative to produce an oscillatory response waveform;

a driver sensor that is operative to sense said oscillatory response waveform;

an eccentric hydraulic motor that drives said eccentric;

an eccentric hydraulic valve that controls the amount or pressure of said hydraulic fluid introduced to said eccentric hydraulic motor;

an eccentric pressure sensor that senses the pressure of said hydraulic fluid introduced to said eccentric hydraulic motor;

an eccentric sensor that senses the rate of rotation of said eccentric;

a rotation hydraulic motor that rotates said drill string;

a rotation hydraulic valve that controls the amount or pressure of said hydraulic fluid introduced to said rotation hydraulic motor;

a rotation pressure sensor that senses the pressure of said hydraulic fluid introduced to said rotational hydraulic motor;

a rotary sensor or rotation sensor that senses the rate of rotation of said drill string;

a hydraulic piston or push-pull piston comprising a push mechanism and a pull mechanism;

a push-pull hydraulic valve that controls the amount or pressure of said hydraulic fluid introduced to said hydraulic piston or push-pull piston;

a pull pressure sensor that senses the pressure of said hydraulic fluid introduced to said pull mechanism;

a push pressure sensor that senses the pressure of said hydraulic fluid introduced to said push mechanism;

a push-pull position sensor that senses the position of said drill string; and a programmable logic controller that accepts input from said sensors, analyzes said input and sends output to said valves;

wherein said programmable logic controller is operative to determine a phase angle between said oscillatory input force waveform and said oscillatory response waveform.

16. The sonic drill control system of claim 15 further comprising:

a frame; and a pneumatic spring for supporting said sonic drill and isolating sonic drill vibrations from said frame; said pneumatic spring being operative to change the resonant frequency of said sonic drill.

17. The sonic drill control system of claim 15 further comprising:

a signal conditioning board for converting raw signals produced by at least some of said sensors into usable signals.

18. A control system for a sonic drill apparatus, said sonic drill apparatus comprising components including a drill rig or frame, a sonic head comprising rotating eccentrics that vibrate in accordance with an oscillatory input force waveform, a drill string that vibrates in accordance with an oscillatory response waveform and a drill bit, said control system comprising:

means for driving the sonic drill apparatus;

means for measuring a response of the sonic drill apparatus; and means for establishing an operating state of the sonic drill apparatus;

wherein said means for measuring a response measures at least a phase angle between the oscillatory input force waveform and the oscillatory response waveform and is disposed above ground.

19. The control system of claim 18 wherein:

said means for driving the sonic drill apparatus is selected from the group consisting of:

means for imposing a rate of rotation on a rotatable component of the sonic drill apparatus;

means for imposing a push-pull force on the drill string;

means for imposing a rotational torque on the drill string or the drill bit;

means for imposing an input force frequency on the eccentrics;

means for imposing an input force amplitude by the eccentrics onto the drill string;

means for imposing an input torque on the eccentrics; and means for imposing a coupling rate between the sonic head and the drill rig or frame.

20. A control system for a sonic drill apparatus, said sonic drill apparatus comprising components including a drill rig or frame, a sonic head comprising eccentrics that vibrate in accordance with an oscillatory input force waveform, a drill string that vibrates in accordance with an oscillatory response waveform, and a drill bit, said control system comprising:

means for driving the sonic drill apparatus;

means for measuring a response of the sonic drill apparatus; and means for establishing an operating state of the sonic drill apparatus;

wherein said means for measuring a response measures at least a phase angle between the oscillatory input force waveform and the oscillatory response waveform;

wherein said means for driving the sonic drill apparatus is selected from the group consisting of:

means for imposing a rate of rotation on a rotatable component of the sonic drill apparatus;

means for imposing a push-pull force on the drill string;

means for imposing a rotational torque on the drill string or the drill bit;

means for imposing an input force frequency on the eccentrics;

means for imposing an input force amplitude by the eccentrics onto the drill string;

means for imposing an input torque on the eccentrics; and means for imposing a coupling rate between the sonic head and the drill rig or frame;

wherein said rate of rotation is a speed at which the drill string is rotating relative to the drill head, a speed at which the drill bit is rotating relative to the drill head, or a speed at which the drill bit is rotating relative to the drill string.

21. The control system of claim 20 wherein:

said means for measuring a response of the sonic drill apparatus is selected from the group consisting of:

means for measuring a rate of penetration;

means for measuring a power utilization;

means for measuring a power efficiency;

means for measuring a power factor;

means for measuring a sound pressure;

means for measuring a sound intensity;

means for measuring a phase difference between the oscillatory input force waveform and a measured value that characterizes the oscillatory displacement waveform; and means for characterizing the oscillatory displacement waveform.

22. The control system of claim 21 wherein the oscillatory response waveform is characterized by measuring an acceleration, a velocity, a displacement or a jerk at a location on said sonic drill apparatus that characterizes said response at an input force location.

23. The control system of claim 20 wherein:

said means for establishing an operating state of the sonic drill apparatus is selected from the group consisting of:

means for establishing a maximum penetration efficiency;

means for establishing a maximum penetration rate;

means for establishing a maximum drill string acceleration amplitude or a specific drill string acceleration amplitude;

means for establishing a maximum drill string velocity amplitude or specific drill string velocity amplitude;

means for establishing a maximum drill string displacement amplitude or specific drill string displacement amplitude; and means for establishing a maximum drill string jerk amplitude or specific drill string jerk amplitude.

24. The control system of claim 20 wherein said means for imposing a push-pull force on the drill string is selected from the group consisting of: a hydraulic cylinder, a chain or cable, gravity, a pneumatic cylinder, and a magnetic or electrical means for imposing force.

25. The control system of claim 20 wherein said means for imposing an input force amplitude on the eccentrics or the drill string is selected from the group consisting of: a hydraulic piston, a hydraulic motor, a pneumatic piston, a pneumatic motor, an electric rotary motor, an electric linear motor, a linear servo motor, a voice coil and a piezoelectric actuator.

26. The control system of claim 20 wherein an output of said means for imposing an input force amplitude on the eccentrics or the drill string is modified by adjusting a hydraulic pressure, a hydraulic flow rate, and electric voltage, an electric current, a pneumatic pressure, and a pneumatic flow rate.

27. A control system for a sonic drill apparatus, said sonic drill apparatus comprising components including a drill rig or frame, a sonic head comprising means for imposing an input force that vibrate in accordance with an oscillatory input force waveform, a part that vibrates in accordance with an oscillatory displacement waveform and a drill bit, said control system comprising:

means for driving the sonic drill apparatus;

means for measuring a response of the sonic drill apparatus; and means for establishing an operating state of the sonic drill apparatus;

wherein said means for measuring a response measures at least a phase angle between the oscillatory input force waveform and the oscillatory displacement waveform and is disposed above ground.

28. The control system of claim 27 wherein said phase angle is about minus ninety degrees.

29. The control system of claim 27 further comprising:

means for detecting whether the control system is operating in an unsafe operating condition.

30. The control system of claim 27 wherein said means for detecting is selected from the group consisting of:

means for detecting when decoupling between said drill bit and said drilling media is occurring;

means for detecting when the part is over stressed;

means for detecting when said means for measuring a response of the sonic drill apparatus is inoperative; and means for detecting when said means for driving the sonic drill apparatus is not under control.

31. The control system of claim 27 wherein the part is a drill string.

32. An oscillatory penetration apparatus, said oscillatory penetration apparatus comprising components including a frame, a sonic head comprising means for imposing an input force that vibrate in accordance with an oscillatory input force waveform, and a part that vibrates in accordance with an oscillatory displacement waveform, said oscillatory penetration apparatus comprising:

means for driving the oscillatory penetration apparatus;

means for measuring a response of the oscillatory penetration apparatus; and means for controlling the oscillatory penetration apparatus;

wherein said means for measuring a response measures at least a phase angle between the oscillatory input force waveform and the oscillatory displacement waveform and is disposed above ground.

33. The control system of claim 32 wherein the part is selected from the group consisting of:

a pile;

a drill bit;

a coring bit;
a horn;
a free mass;
a drill stem; and
a drill pipe.

34. The control system of claim 32 wherein said means for controlling the oscillatory penetration apparatus is selected from the group consisting of:
an electric circuit;
a mechanical system;
a personal computer;
a programmable logic controller; and
a microcontroller.

35. An apparatus comprising:
a member that is operative to perform a linear vibration, said linear vibration having an oscillating response waveform;
means for applying an oscillating input force to said member, said oscillating input force having an oscillating input force waveform having a frequency;
means for measuring a response of said member, said means for measuring a response of said member being disposed above ground and measuring at least a phase angle between said oscillatory input force waveform and said oscillatory response waveform;
means for applying a non-oscillating push-pull force to said member, said non-oscillating, push-pull force having a magnitude and a direction; and
means for controlling said frequency, said magnitude and said direction;
wherein said means for controlling is operative to detect whether said member is moving excessively and being operative to measure at least a phase angle between the oscillatory input force waveform and the oscillatory response waveform.

36. A method for controlling a sonic drill having a displacement and an operating range and operating at a phase angle, said sonic drill comprising a push-pull piston and rotating eccentrics, said method comprising:
operating the push-pull piston at an initial push-pull force while the rotating eccentrics are operated at a plurality of different operating frequencies within the operating range of the sonic drill and measuring the displacement at each operating frequency;
determining an efficient operating frequency for the material being drilled and operating the eccentrics at said efficient operating frequency;
determining the phase angle at which the sonic drill is operating by means of a sensor that is disposed above ground; and
if the phase angle is not substantially equal to minus ninety degrees, operating the push-pull piston at another push-pull force.

37. A method comprising:
applying an oscillating input force to a member, said oscillating input force having an oscillating input force waveform having a frequency, said member performing a linear vibration in response to said oscillating input force, said linear vibration having an oscillating response waveform;
applying a non-oscillating push-pull force to said member, said non-oscillating, push-pull force having a magnitude and a direction;
detecting whether said member is vibrating excessively and measuring above ground at least a phase angle between the oscillatory input force waveform and the oscillatory response waveform; and
controlling said frequency, said magnitude and said direction.

38. A method for controlling a sonic drill apparatus, said sonic drill apparatus comprising components including a drill rig or frame, a sonic head comprising one or more pairs of eccentrics that vibrate in accordance with an oscillatory input force waveform, a drill string that vibrates in accordance with an oscillatory displacement waveform and a drill bit, said control system comprising:
driving the sonic drill apparatus;
measuring a response of the sonic drill apparatus; and
establishing an operating state of the sonic drill apparatus;
wherein measuring a response comprises measuring above ground at least a phase angle between the oscillatory input force waveform and the oscillatory displacement waveform.

39. A method for controlling a sonic drill apparatus, said sonic drill apparatus comprising components including a drill rig or frame, a sonic head comprising excitation means that vibrate in accordance with an oscillatory input force waveform, a drill string that vibrates in accordance with an oscillatory displacement waveform and a drill bit, said control system comprising:
a step for driving the sonic drill apparatus;
a step for measuring a response of the sonic drill apparatus; and
a step for establishing an operating state of the sonic drill apparatus;
wherein measuring a response comprises measuring at the top of the drill string at least a phase angle between the oscillatory input force waveform and the oscillatory displacement waveform.

40. A method for controlling a sonic drill apparatus, said sonic drill apparatus comprising components including a drill rig or frame, a sonic head comprising excitation means that vibrate in accordance with an oscillatory input force waveform, a drill string that vibrates in accordance with an oscillatory displacement waveform and a drill bit, said control system comprising:
a step for driving the sonic drill apparatus;
a step for measuring a response of the sonic drill apparatus; and
a step for establishing an operating state of the sonic drill apparatus;
wherein said step for measuring a response comprises a step for measuring at the top of the drill string at least a phase angle between the oscillatory input force waveform and the oscillatory displacement waveform.

41. A system for controlling a sonic drill having a displacement and an operating range and operating at a phase angle, said sonic drill comprising a drill string, a push-pull piston, and eccentrics, said system comprising:
means for operating the push-pull piston at an initial push-pull force while the eccentrics are operated at a plurality of different operating frequencies within the operating range of the sonic drill and measuring the displacement at each operating frequency;
means for determining an efficient operating frequency for the material being drilled and operating the eccentrics at said efficient operating frequency;
means for determining the phase angle at which the sonic drill is operating by means of a sensor that is disposed at the top of the drill string; and
means for operating the push-pull piston at another push-pull force if the phase angle is not substantially equal to minus ninety degrees.

42. A system comprising:

means for applying an oscillating input force to a member, said oscillating input force having an oscillating input force waveform having a frequency, said member performing a linear vibration in response to said oscillating input force, said linear vibration having an oscillating displacement waveform;

means for applying a non-oscillating push-pull force to said member, said non-oscillating, push-pull force having a magnitude and a direction;

means for detecting whether said member is vibrating excessively and measuring at the top of the member at least a phase angle between the oscillatory input force waveform and the oscillatory displacement waveform; and means for controlling said frequency, said magnitude and said direction.

43. A system for controlling a sonic drill apparatus, said sonic drill apparatus comprising components including a drill rig or frame, a sonic head comprising eccentrics that vibrate in accordance with an oscillatory input force waveform, a drill string that vibrates in accordance with an oscillatory displacement waveform and a drill bit, said control system comprising:

means for driving the sonic drill apparatus;

means for measuring a response of the sonic drill apparatus; and means for establishing an operating state of the sonic drill apparatus;

wherein said means for measuring a response comprises means for measuring at the top of the drill string at least a phase angle between the oscillatory input force waveform and the oscillatory displacement waveform.

44. A system for automatic control of an oscillatory penetration apparatus, said oscillatory penetration apparatus comprising a driver that is operative to produce an oscillatory input force waveform and a drill stem having an oscillatory displacement waveform, said system comprising:

means for detecting a phase difference between the oscillatory input force waveform and the oscillatory displacement waveform adjacent the top of the drill string; and means for using said phase difference to control the frequency of said oscillatory input force waveform.

45. The system of claim 44 wherein the oscillatory penetration apparatus further comprises a drill rig that is operative to produce a push-pull force and said system further comprises:

means for using said phase difference to control the magnitude and direction of a push-pull force.

46. A method for controlling an oscillatory penetration apparatus, said oscillatory penetration apparatus having a part that is being subjected to an oscillating force that has a frequency and an amplitude and that is being subjected to a push-pull force having a magnitude, said method comprising:

performing a safety control process comprising:

accepting data characterizing the oscillatory penetration apparatus;

manipulating said data to determine a maximum safe amplitude of oscillations of the oscillatory penetration apparatus;

sensing an actual amplitude of oscillations of the oscillatory penetration apparatus during its operation;

determining if a ratio of said actual oscillations to said maximum safe amplitude is greater than one;

if said ratio is greater than one, shutting down the oscillatory penetration apparatus;

if the ratio is not greater than one, determining if the ratio is greater than a preselected value that is less than one or is running away;

if the ratio is not greater than said preselected value and is not running away, then allowing the oscillatory penetration apparatus to operate normally; and if the ratio is greater than about said preselected value or is running away, then adjusting the frequency, adjusting the push-pull force and/or adjusting the amplitude to reduce said ratio of said actual oscillations to said maximum safe amplitude; and/or performing a normal control process comprising:

(1) accepting data characterizing the oscillatory penetration apparatus;

(2) performing a frequency sweep;

(3) determining an optimum resonant operating point for said oscillatory penetration apparatus and logging resonant frequencies;

(4) setting an input force frequency that is higher than said optimum resonant operating point;

(5) adjusting said input force frequency down to produce a phase lag;

(6) testing whether said phase lag between said input force waveform and a displacement waveform of −90 degrees has been achieved, and if a phase lag of −90 degrees has been achieved, going to step (14);

(7) if a phase lag of −90 degrees has not been achieved, decreasing the magnitude of the push-pull force to produce a second phase lag;

(8) retesting said phase lag, and if said phase lag of −90 degrees has been achieved, going to step (14);

(9) if said phase lag of −90 degrees has still not been achieved, determining whether the magnitude of the push-pull force is greater than zero, and if the magnitude of the push-pull force is greater than zero, going to step (14);

(10) if the magnitude of the push-pull force is not greater than zero, increasing the push force;

(11) checking said phase lag, and if said phase lag of −90 degrees has been achieved, going to step (14);

(12) determining whether a penetration rate is negative, and if said penetration rate is negative, going to step (13);

(13) adjusting said input force frequency to another resonant frequency and going to step (4);

(14) adjusting a rate of rotation, said push-pull force magnitude and/or direction, said input force amplitude (if applicable), a flushing fluid flow rate (if applicable), and/or said input force frequency to achieve a maximum penetration rate;

(15) rechecking whether said phase lag can be achieved while said maximum penetration rate is achieved, and if not, going to step (4); and

(16) if said phase lag can be achieved while said maximum penetration rate is achieved, operating at constant conditions until stopping is necessary.

* * * * *